US008543389B2

(12) United States Patent
Ragot et al.

(10) Patent No.: US 8,543,389 B2
(45) Date of Patent: Sep. 24, 2013

(54) CODING/DECODING OF DIGITAL AUDIO SIGNALS

(75) Inventors: Stéphane Ragot, Lannion (FR); Cyril Guillaume, Beaurepaire (FR)

(73) Assignee: France Telecom, Paris (FR)

( * ) Notice: Subject to any disclaimer, the term of this patent is extended or adjusted under 35 U.S.C. 154(b) by 1085 days.

(21) Appl. No.: 12/524,774

(22) PCT Filed: Jan. 30, 2008

(86) PCT No.: PCT/FR2008/050150

§ 371 (c)(1),
(2), (4) Date: Jul. 28, 2009

(87) PCT Pub. No.: WO2008/104663

PCT Pub. Date: Sep. 4, 2008

(65) Prior Publication Data

US 2010/0121646 A1 May 13, 2010

(30) Foreign Application Priority Data

Feb. 2, 2007 (FR) ..... 07 00747

(51) Int. Cl.
*G10L 19/04* (2006.01)

(52) U.S. Cl.
USPC ..... 704/219; 704/200.1; 704/229; 704/230; 704/225; 704/500

(58) Field of Classification Search
USPC ..... 704/200.1, 229, 230, 205, 500–504, 704/203, 204, 224, 225, 219, 211, 206, 226–228, 704/222
See application file for complete search history.

(56) References Cited

U.S. PATENT DOCUMENTS

| | | | | |
|---|---|---|---|---|
| 5,623,577 | A * | 4/1997 | Fielder | 704/200.1 |
| 5,632,003 | A * | 5/1997 | Davidson et al. | 704/200.1 |
| 5,790,759 | A * | 8/1998 | Chen | 704/200.1 |
| 6,014,621 | A * | 1/2000 | Chen | 704/220 |
| 6,363,338 | B1 * | 3/2002 | Ubale et al. | 704/200.1 |
| 7,333,930 | B2 * | 2/2008 | Baumgarte | 704/200.1 |
| 7,562,021 | B2 * | 7/2009 | Mehrotra et al. | 704/500 |
| 8,209,188 | B2 * | 6/2012 | Oshikiri | 704/500 |

(Continued)

OTHER PUBLICATIONS

Dong et al., "A Multiple Description Speech Coder Based on AMR-WB for Mobile Ad Hoc Networks," IEEE International Conference on Acoustics, Speech, and Signal Processing (ICASSP), May 17-21, 2004, vol. 1, pp. I-227-I-280 (May 2004).

(Continued)

*Primary Examiner* — Vijay B Chawan
(74) *Attorney, Agent, or Firm* — Drinker Riddle & Reath LLP

(57) ABSTRACT

The invention relates to the coding/decoding of a signal into several sub-bands, in which at least a first and a second sub-bands which are adjacent are transform coded (601, 602). In particular, in order to apply a perceptual weighting, in the transformed domain, to at least the second sub-band, the method comprises:—determining at least one frequency masking threshold (606) to be applied on the second sub-band; and normalizing said masking threshold in order to provide a spectral continuity between the above-mentioned first and second sub-bands. An advantageous application of the invention involves a perceptual weighting of the high-frequency band in the TDAC transform coding of a hierarchical encoder according to standard G.729.1.

19 Claims, 14 Drawing Sheets

(56) References Cited

U.S. PATENT DOCUMENTS

| | | | | |
|---|---|---|---|---|
| 8,229,738 | B2 * | 7/2012 | Crebouw | 704/207 |
| 2004/0181393 | A1 * | 9/2004 | Baumgarte | 704/200.1 |
| 2007/0016414 | A1 * | 1/2007 | Mehrotra et al. | 704/230 |
| 2008/0126082 | A1 * | 5/2008 | Ehara et al. | 704/205 |
| 2010/0286990 | A1 * | 11/2010 | Biswas et al. | 704/500 |

OTHER PUBLICATIONS

International Telecommunication Union, "G.729 based Embedded Variable bit-rate coder: An 8-32 kbit/s scalable wideband coder bitstream interoperable with G.729," ITU-T Standard Pre-Published, Geneva, CH, No. G7291 5/6, pp. 1-99 (May 29, 2006).

Mahieux et al., "High-Quality Audio Transform Coding at 64 kbps," IEEE Transactions on Communications, IEEE Service Center, Piscataway, NJ, US, vol. 42 (11), pp. 3010-3019 (Nov. 1, 1994).

Ragot et al., "A 8-32 KBIT/S Scalable Wideband Speech and Audio Coding Candidate for ITU-T G729EV Standardization," 2006 IEEE International Conference on Acoustics, Speech and Signal Processing, Toulouse, France May 14-19, 2006, ICASSP 2006 Proceedings, Piscataway, NJ, USA, IEEE, pp. I-1-I-4 (May 14, 2006).

* cited by examiner

CODING/DECODING OF DIGITAL AUDIO SIGNALS

CROSS-REFERENCE TO RELATED APPLICATIONS

This application is the U.S. national phase of the International Patent Application No. PCT/FR2008/050150 filed Jan. 30, 2008, which claims the benefit of French Application No. 07 00747 filed Feb. 2, 2007, the entire content of which is incorporated herein by reference.

BACKGROUND OF THE INVENTION

The present invention relates to processing acoustic data.

This processing is suitable in particular for the transmission and/or storage of digital signals such as audio-frequency signals (speech, music, or other).

Various techniques exist for coding an audio-frequency signal in digital form. The most common techniques are:

- waveform encoding methods such as pulse code modulation (PCM) and adaptive differential pulse code modulation (ADPCM).
- analysis-by-synthesis parametric coding methods such as code excited linear prediction (CELP) coding and
- sub-band perceptual coding methods or transform coding.

These techniques process the input signal sequentially, sample by sample (PCM or ADPCM) or by blocks of samples called "frames" (CELP and transform coding).

Briefly, it will be recalled that a sound signal such as a speech signal can be predicted from its recent past (for example from 8 to 12 samples at 8 kHz) using parameters assessed over short windows (10 to 20 ms in this example). These short-term predictive parameters representing the vocal tract transfer function (for example for pronouncing consonants), are obtained by linear prediction coding (LPC) methods. A longer-term correlation is also used to determine periodicities of voiced sounds (for example the vowels) resulting from the vibration of the vocal cords. This involves determining at least the fundamental frequency of the voiced signal, which typically varies from 60 Hz (low voice) to 600 Hz (high voice) according to the speaker. Then a long term prediction (LTP) analysis is used to determine the LTP parameters of a long-term predictor, in particular the inverse of the fundamental frequency, often called "pitch period". The number of samples in a pitch period is then defined by the ratio $F_e/F_0$ (or its integer part), where:

$F_e$ is the sampling rate, and $F_0$ is the fundamental frequency.

It will be recalled therefore that the long-term prediction LTP parameters, including the pitch period, represent the fundamental vibration of the speech signal (when voiced), while the short-term prediction LPC parameters represent the spectral envelope of this signal.

In certain coders, the set of these LPC and LTP parameters thus resulting from a speech coding can be transmitted by blocks to a homologous decoder via one or more telecommunications networks so that the original speech can then be reconstructed.

In standard speech coding, the coder generates a fixed bit rate bitstream. This bit-rate constraint simplifies the implementation and use of the coder and the decoder. Examples of such systems are the UIT-T G.711 64 kbit/s coding standard, the UIT-T G.729 8 kbit/s coding standard, or the GSM-EFR 12.2 kbit/s coding.

In certain applications (such as mobile telephony or voice over IP (Internet Protocol), it is preferable to generate a variable-rate bitstream. The bit-rate values are taken from a predefined set. Such a coding technique, called "multi-rate", thus proves more flexible than a fixed bit-rate coding technique.

Several multi-rate coding techniques can be distinguished:

- source- and/or channel-controlled multi-mode coding, used in particular in 3GPP AMR-NB, 3GPP AMR-WB, or 3GPP2 VMR-WB coders,
- hierarchical, or "scalable" coding, which generates a so-called "hierarchical" bitstream since it comprises a core bit rate and one or more enhancement layers (standard coding according to G.722 at 48, 56 and 64 kbit/s being typically bit-rate scalable, while UIT-T G.729.1 and MPEG-4 CELP codings are both bit-rate and bandwidth-scalable),
- multiple-description coding, described in particular in: "*A multiple description speech coder based on AMR-WB for mobile ad hoc networks*", H. Dong, A. Gersho, J. D. Gibson, V. Cuperman, ICASSP, p. 277-280, vol. 1 (May 2004).

Details will be given below of hierarchical coding, having the capacity to provide varied bit rates by distributing the information relating to an audio signal to be coded in hierarchically-arranged subsets, so that this information can be used by order of importance with respect to the audio rendering quality. The criterion taken into account for determining the order is an optimization (or rather minimum degradation) criterion of the quality of the coded audio signal. Hierarchical coding is particularly suited to transmission on heterogeneous networks or those having available bit rates varying over time, or also transmission to terminals having variable capacities.

The basic concept of hierarchical (or "scalable") audio coding can be described as follows.

The bitstream comprises a base layer and one or more enhancement layers. The base layer is generated by a (fixed) low bit-rate codec classified as a "core codec" guaranteeing the minimum quality of the coding. This layer must be received by the decoder in order to maintain an acceptable level of quality. The enhancement layers serve to enhance the quality. It can occur however that they are not all received by the decoder.

The main advantage of hierarchical coding is that it then allows an adaptation of the bit rate simply by "bitstream truncation". The number of layers (i.e. the number of possible bitstream truncations) defines the granularity of the coding. The expression "high granularity" is used if the bitstream comprises few layers (of the order of 2-4) and "fine granularity" coding allows for example a pitch of the order of 1-2 kbit/s.

More particularly described below are bit-rate and bandwidth-scalable coding techniques with a CELP-type core coder in a telephony band, plus one or more enhancement layers in wideband. An example of such systems is given in the UIT-T G.729.1 8-32 kbit/s fine granularity standard. The G.729.1 coding/decoding algorithm is summarized hereafter.

Reminders on the G.729.1 Coder

The G.729.1 coder is an extension of the UIT-T G.729 coder. This is a modified G.729 hierarchical core coder, producing a signal the band of which extends from narrowband (50-4000 Hz) to wideband (50-7000 Hz) at a bit rate of 8-32 kbit/s for speech services. This codec is compatible with existing voice over IP equipment (for the most part equipped according to standard G.729). It is appropriate to point out finally that standard G.729.1 was approved in May 2006.

The G.729.1 coder is shown diagrammatically in FIG. 1. The wideband input signal $s_{wb}$, sampled at 16 kHz, is firstly split into two sub-bands by quadrature mirror filtering (QMF). The low band (0-4000 Hz) is obtained by low-pass filtering LP (block 100) and decimation (block 101), and the high band (4000-8000 Hz) by high-pass filtering HP (block 102) and decimation (block 103). The LP and HP filters are of length 64 bits.

The low band is pre-processed by a high-pass filter removing components below 50 Hz (block 104), in order to obtain the signal $s_{LB}$, before narrowband CELP coding (block 105) at 8 and 12 kbit/s. This high-pass filtering takes into account the fact that the useful band is defined as covering the range 50-7000 Hz. The narrowband CELP coding is a CELP cascade coding comprising as a first stage a modified G.729 coding without a pre-processing filter and as a second stage an additional fixed CELP dictionary.

The high band is firstly pre-processed (block 106) in order to compensate for the aliasing due to the high-pass filter (block 102) in combination with the decimation (block 103). The high band is then filtered by a low-pass filter (block 107) eliminating the high-band components between 3000 and 4000 Hz (i.e. the components in the original signal between 7000 and 8000 Hz) in order to obtain the signal $s_{HB}$. Band expansion (block 108) is then carried out.

A significant feature of the G.729.1 encoder according to FIG. 1 is the following. The low-band error signal $d_{LB}$ is computed (block 109) on the basis of the output of the CELP coder (block 105) and a predictive transform coding (for example of the TDAC (time domain aliasing cancellation) type in standard G.729.1) is carried out at block 110. With reference to FIG. 1, it can be seen in particular that the TDAC encoding is applied both to the low-band error signal and to the high-band filtered signal.

Additional parameters can be transmitted by block 111 to a corresponding decoder, this block 111 carrying out a processing called "FEC" for "Frame Erasure Concealment", in order to reconstitute any erased frames.

The different bitstreams generated by coding blocks 105, 108, 110 and 111 are finally multiplexed and structured in a hierarchical bitstream in the multiplexing block 112. The coding is carried out by blocks of samples (or frames) of 20 ms, i.e. 320 samples per frame.

The G.729.1 codec thus has a three-stage coding architecture comprising:

CELP cascade coding, expansion of bandwidth parameters by the time domain bandwidth extension (TDB WE) type module 108, and TDAC predictive transform coding, applied after a modified discrete cosine transform (MDCT) type transform.

Reminders on the G.729.1 Decoder

The corresponding decoder according to standard G.729.1 is shown in FIG. 2. The bits describing each frame of 20 ms are demultiplexed in block 200.

The bitstream of layers at 8 and 12 kbit/s is used by the CELP decoder (block 201) to generate the narrowband synthesis (0-4000 Hz). The portion of the bitstream associated with the layer at 14 kbit/s is decoded by the bandwidth expansion module (block 202). The portion of the bitstream associated with bit rates higher than 14 kbit/s is decoded by the TDAC module (block 203). A pre- and post-echo processing is carried out by blocks 204 and 207 as well as an enhancement (block 205) and post-processing of the low band (block 206).

The wideband output signal $\hat{s}_{wb}$, sampled at 16 kHz, is obtained using the QMF synthesis filterbank (blocks 209, 210, 211, 212 and 213) integrating the aliasing cancellation (block 208).

The description of the transform coding layer is detailed hereafter.

Reminders on the TDAC Transform Coder in the G.729.1 Coder

The TDAC type transform coding in the G.729.1 coder is shown in FIG. 3.

The filter $W_{LB}(z)$ (block 300) is a perceptual weighting filter, with gain compensation, applied to the low band error signal $d_{LB}$. MDCT transforms are then computed (block 301 and 302) in order to obtain:

the MDCT spectrum $D_{LB}^{w}$ of the difference signal, perceptually filtered, and the MDCT spectrum $S_{HB}$ of the original high-band signal.

These MDCT transforms (blocks 301 and 302) are applied to 20 ms of signal sampled at 8 kHz (160 coefficients). The spectrum Y(k) coming from the merging block 303 thus comprises 2×160, i.e. 320 coefficients. It is defined as follows:

$$[Y(0)Y(1)\ldots Y(319)]=[D_{LB}^{w}(0)D_{LB}^{w}(1)\ldots D_{LB}^{w}(159)S_{HB}(0)S_{HB}(1)\ldots S_{HB}(159)]$$

This spectrum is divided into eighteen sub-bands, a sub-band j being allocated a number of coefficients denoted nb_coef(j). The division into sub-bands is specified in Table 1 hereafter.

Thus, a sub-band j comprises the coefficients Y(k) with sb_bound(j)≦k<sb_bound(j+1).

TABLE 1

Boundaries and size of the sub-bands in TDAC coding

| J | sb_bound(j) | nb_coef(j) |
|---|---|---|
| 0 | 0 | 16 |
| 1 | 16 | 16 |
| 2 | 32 | 16 |
| 3 | 48 | 16 |
| 4 | 64 | 16 |
| 5 | 80 | 16 |
| 6 | 96 | 16 |
| 7 | 112 | 16 |
| 8 | 128 | 16 |
| 9 | 144 | 16 |
| 10 | 160 | 16 |
| 11 | 176 | 16 |
| 12 | 192 | 16 |
| 13 | 208 | 16 |
| 14 | 224 | 16 |
| 15 | 240 | 16 |
| 16 | 256 | 16 |
| 17 | 272 | 8 |
| 18 | 280 | — |

The spectral envelope $\{\log_rms(j)\}_{j=0,\ldots,17}$ is computed in block 304 according to the formula:

$$\log_rms(j) = \frac{1}{2}\log_2\left[\frac{1}{nb_coef(j)}\sum_{k=sb_bound(j)}^{sb_bound(j+1)-1} Y(k)^2 + \varepsilon_{rms}\right],$$

$$j = 0, \ldots, 17$$

where $$\varepsilon_{rms} = 2^{-24}.$$

The spectral envelope is coded at a variable bit rate in block 305. This block 305 produces quantized integer values denoted rms_index(j) (with j=0 . . . , 17), obtained by simple scalar quantization:

$$rms_index(j)=round(2\cdot\log_rms(j))$$

where the notation "round" denotes rounding to the nearest integer, and with the constraint:

$$-11 \leqq rms_index(j) \leqq +20$$

This quantized value rms_index(j) is transmitted to the bit allocation block 306.

Coding of the spectral envelope itself is also carried out by block 305, separately for the low band (rms_index(j), with j=0, . . . , 9), and for the high band (rms_index(j), with j=10, . . . , 17). In each band, two types of coding can be chosen according to a given criterion, and, more precisely, the values rms_index(j):

- can be encoded by coding called "differential Huffman coding",
- or can be encoded by natural binary coding.

A bit (0 or 1) is transmitted to the decoder in order to indicate the chosen coding mode.

The number of bits allocated to each sub-band for its quantization is determined at block 306, on the basis of the quantized spectral envelope coming from block 305. The bit allocation carried out minimizes the root mean square deviation while respecting the constraint of a whole number of bits allocated per sub-band and a maximum number of bits that is not to be exceeded. The spectral content of the sub-bands is then encoded by spherical vector quantization (block 307).

The different bitstreams generated by blocks 305 and 307 are then multiplexed and structured in a hierarchical bitstream at the multiplexing block 308.

Reminder on the Transform Decoder in the G.729.1 Decoder

The stage of TDAC type transform decoding in the decoder G.729.1 is shown in FIG. 4.

In a similar manner to the encoder (FIG. 3), the decoded spectral envelope (block 401) makes it possible to retrieve the bit allocation (block 402). The envelope decoding (block 401) reconstructs the quantized values of the spectral envelope (rms_index(j), for j=0, . . . , 17), on the basis of the (multiplexed) bitstream generated by the block 305, deducing the decoded envelope therefrom:

$$rms_q(j)=2^{1/2\ rms_index(j)}$$

The spectral content of each of the sub-bands is retrieved by inverse spherical vector quantization (block 403). The sub-bands which are not transmitted due to an insufficient "bit budget" are extrapolated (block 404) on the basis of the MDCT transform of the output signal of the band extension (block 202 in FIG. 2).

After level adjustment of this spectrum (block 405) in relation to the spectral envelope and post-processing (block 406), the MDCT spectrum is split in two (block 407):

- with 160 first coefficients corresponding to the spectrum $\hat{D}_{LB}^{w}$ of the low band decoded difference signal, perceptually filtered,
- and 160 following coefficients corresponding to the spectrum $\hat{S}_{HB}$ of the original high-band decoded signal.

These two spectra are transformed into time signals by inverse MDCT transform, denoted IMDCT (blocks 408 and 410), and the inverse perceptual weighting (filter denoted $W_{LB}(z)^{-1}$ is applied to the signal $\hat{d}_{LB}^{w}$ (block 409) resulting from the inverse transform.

The allocation of bits to the sub-bands (block 306 in FIG. 3 or block 402 in FIG. 4) is more particularly described hereafter.

Blocks 306 and 402 carry out an identical operation on the basis of the values rms_index(j), j=0, . . . , 17. Thus it will be considered sufficient to describe below the functions of block 306 only.

The purpose of the binary allocation is to distribute between each of the sub-bands a certain (variable) bit budget denoted nbits_VQ, with:

nbits_VQ=351−nbits_rms, where nbits_rms is the number of bits used by the coding of the spectral envelope.

The result of the allocation is the whole number of bits, denoted nbit(j) (with j=0, . . . , 17), allocated to each of the sub-bands, having as an overall constraint:

$$\sum_{j=0}^{17} nbit(j) \approx \text{nbits_VQ}$$

In standard G.729.1, the values nbit(j) (j=0, . . . , 17), are moreover constrained by the fact that nbit(j) must be chosen from a restricted value set specified in Tableau 2 below.

TABLE 2

Possible values for number of bits allocated in TDAC sub-bands.

| Size of the sub-band j nb_coef(j) | Set of permitted values for nbit(j) (in number of bits) |
|---|---|
| 8 | $R_8 = \{0, 7, 10, 12, 13, 14, 15, 16\}$ |
| 16 | $R_{16} = \{0, 9, 14, 16, 17, 18, 19, 20, 21, 22, 23, 24, 25, 26, 27, 28, 29, 30, 31, 32\}$ |

The allocation in standard G.729.1 relies on a "perceptual importance" per sub-band linked to the sub-band energy, denoted ip(j) (j=0 . . . 17), defined as follows:

$$ip(j) = \frac{1}{2}\log_2(\text{rms_q}(j)^2 \times \text{nb_coef}(j)) + \text{offset}$$

where $$\text{offset} = -2.$$

Since the values rms_q(j)=$2^{1/2\ rms_index(j)}$, this formula can be simplified in the form:

$$ip(j) = \begin{cases} \frac{1}{2}\text{rms_index}(j) & \text{for } j = 0, \ldots, 16 \\ \frac{1}{2}(\text{rms_index}(j) - 1) & \text{for } j = 17 \end{cases}$$

On the basis of the perceptual importance of each sub-band, the allocation nbit(j) is computed as follows:

$$nbit(j) = \arg_{r \in R_{nb_coef(j)}} \min |\text{nb_coef}(j) \times (ip(j) - \lambda_{opt}) - r|$$

where $\lambda_{opt}$ is a parameter optimized by dichotomy.

The incidence of the perceptual weighting (filtering of block 300) on the bit allocation (block 306) of the TDAC transform coder will now be described in more detail.

In standard G.729.1, the TDAC coding uses the perceptual weighting filter $W_{LB}(z)$ in the low band (block 300), as described above. In substance, the perceptual weighting filtering makes it possible to shape the coding noise. The principle of this filtering is to use the fact that it is possible to inject more noise in the frequency zones where the original signal has a strong energy.

The perceptual weighting filters most commonly used in narrowband CELP coding have the form $\hat{A}(z/\gamma 1)/\hat{A}(z/\gamma 2)$ where $0<\gamma 2<\gamma 1<1$ and $\hat{A}(z)$ represents a linear prediction spectrum (LPC). Thus the effect of the CELP coding analyse-by-synthesis is to minimize the root mean square deviation in a signal domain perceptually weighted by this type of filter.

However, in order to ensure the spectral continuity when the spectra $D_{LB}^{w}$ and $S_{HB}$ are adjacent (block 303 in FIG. 3), the filter $W_{LB}(z)$ is defined in the form:

$$W_{LB}(z) = fac\frac{\hat{A}(z/\gamma_1)}{\hat{A}(z/\gamma_2)}$$

with $$\gamma_1 = 0.96,$$

$$\gamma_2 = 0.6$$

and $$fac = \left|\frac{\sum_{i=0}^{p}(-\gamma_2)^i\hat{a}_i}{\sum_{i=0}^{p}(-\gamma_1)^i\hat{a}_i}\right|$$

The factor fac allows a filter gain at 1-4 kHz to be provided at the junction of the low and high bands (4 kHz). It is important to note that, in TDAC coding according to standard G.729.1, the coding relies on an energy criterion alone.

Drawbacks of the Prior Art

In standard G.729.1, the encoder TDAC processes in conjunction:

- the signal difference between the original low band and the CELP synthesis, perceptually filtered by a filter of the type $\hat{A}(z/\gamma 1)/\hat{A}(z/\gamma 2)$, gain-compensated (ensuring spectral continuity), and
- the high band which contains the original high-band signal.

The low-band signal corresponds to the 50 Hz-4 kHz frequencies, while the high-band signal corresponds to the 4-7 kHz frequencies.

The joint coding of these two signals is carried out in the MDCT domain according to the root mean square deviation criterion. Thus the high band is coded according to energy criteria, which is sub-optimal (in the "perceptual" sense of the term).

Still more generally, a coding in several bands can be considered, a perceptual weighting filter being applied to the signal of at least one band in the time domain, and the set of sub-bands being coded in conjunction by transform coding. If it is desired to apply perceptual weighting in the frequency domain, the problem then posed is the continuity and homogeneity of the spectra between sub-bands.

SUMMARY OF THE INVENTION

The purpose of the present invention is to improve the situation.

To this end a method is proposed for coding a signal in several sub-bands, in which at least one first and one second sub-bands which are adjacent are transform coded.

With the meaning of the invention, in order to apply a perceptual weighting in the transformed domain, at least to the second sub-band, the method comprises:

- determining at least one frequency masking threshold to be applied on the second sub-band, and
- a standardization of said masking threshold in order to ensure a spectral continuity between said first and second sub-bands.

The present invention therefore proposes to compute a frequential perceptual weighting, using a masking threshold, on one portion only of the frequency band (at least on the above-mentioned "second sub-band") and to ensure spectral continuity with at least one other frequency band (at least the above-mentioned "first sub-band", standardizing the masking threshold on the spectrum covering these two frequency bands.

In a first embodiment of the invention, in which a number of bits to be allocated to each sub-band is determined on the basis of a spectral envelope, the bit allocation for the second sub-band at least is determined moreover as a function of a normalized masking curve computation, applied at least to the second sub-band.

Thus in this first embodiment, instead of providing a bit allocation on the basis of energy criteria alone, the application of the invention makes it possible to allocate the bits to the sub-bands that require the most bits according to a perceptual criterion. Then within the meaning of this first embodiment, a frequential perceptual weighting is applied by masking a portion of the audio band, so as to improve the audio quality by optimizing in particular the distribution of bits between sub-bands according to perceptual criteria.

In a second embodiment of the invention, the transformed signal, in the second sub-band, is weighted by a factor proportional to the square root of the normalized masking threshold for the second sub-band.

In this second embodiment, the normalized masking threshold is not used for the bit allocation to the sub-bands as in the first embodiment above, but it can advantageously be used for directly weighting the signal of the second sub-band at least, in the transformed domain.

The present invention can be applied advantageously, but not limitatively, to a TDAC type transform coding in an overall coder according to standard G.729.1, the first sub-band being included in a band of low frequencies, while the second sub-band is included in a band of high frequencies which can extend up to 7000 Hz or even more (typically up to 14 kHz) by bandwidth expansion. The application of the invention can then consist of providing a perceptual weighting for the high band whilst ensuring spectral continuity with the low band.

It will be recalled that in this type of overall coder having a hierarchical structure, the transform coding takes place in an upper layer of an overall hierarchical coder. Advantageously:

- the first sub-band then comprises a signal originating from a core coding of the hierarchical coder,
- and the second sub-band comprises an original signal.

As in the G.729.1 coder, the signal coming from the core coding can be perceptually weighted and the implementation of the invention is advantageous in the sense that the whole of the spectral band can finally be perceptually weighted.

As in the G.729.1 coder, the signal coming from the core coding can be a signal representing a difference between an original signal and a synthesis of this original signal (called "signal difference" or also "error signal"). It will in fact be seen, with reference to FIG. 12 described below, that advantageously it is not absolutely necessary to have the original signal available in order to implement the invention.

The present invention also relates to a method of decoding, similar to the coding method described above, in which at least one first and one second sub-bands which are adjacent are transform-decoded. In order to apply a perceptual weighting in the transformed domain, at least to the second sub-band, the decoding method then comprises:

- a determination of at least one frequency masking threshold to be applied on the second sub-band, on the basis of a decoded spectral envelope, and a normalization of said masking threshold in order to ensure a spectral continuity between said first and second sub-bands.

A first embodiment of the decoding, similar to the first embodiment of the coding defined above, relates to the allocation of bits at decoding, and a number of bits to be allocated to each sub-band is determined on the basis of a decoding of the spectral envelope. According to an embodiment of the invention, the allocation of bits for the second sub-band at least is determined moreover as a function of a normalized masking curve computation, applied at least to the second sub-band.

A second embodiment of the decoding within the meaning of the invention consists of weighting the transformed signal in the second sub-band, by the square root of the normalized masking threshold. This embodiment will be described in detail with reference to FIG. 10B.

BRIEF DESCRIPTION OF THE DRAWINGS

Moreover, further advantages and features of the invention will become apparent on inspection of the detailed description given by way of example hereafter, and of the attached drawings in which.

DETAILED DESCRIPTION OF THE INVENTION

There will be described below an application of the invention that proves advantageous but not limitative in an encoder/decoder according to standard G.729.1 described previously with reference to FIGS. 1 to 4, incorporating, according to the invention, masking information.

However firstly, the concepts of gain compensation in perceptual filtering and frequency masking are presented below, for better understanding of the principle of the invention.

The invention brings an improvement to the perceptual weighting carried out in the transform coder by using the masking effect known as "simultaneous masking" or "frequency masking".

This property corresponds to alteration of the hearing threshold in the presence of a sound called a "masking sound". This effect is observed typically when, for example, an attempt is made to hold a conversation against ambient noise, for example out in the street, and the noise of a vehicle "masks" a speaker's voice.

An example of the use of the masking in an audio codec can be found in the document by Mahieux et al.:

"*High-quality audio transform coding at* 64 *kbps*", Y. Mahieux, J. P. Petit, IEEE Transactions on Communications, Volume 42, no. 11, Pages: 3010-3019 (November 1994).

In this document, an approximate masking threshold is computed for each line of the spectrum. This threshold is that above which the line in question is assumed to be audible. The masking threshold is computed on the basis of the convolution of the signal spectrum with a spread function B(v) modelling the masking effect of a sound (sinusoidal or filtered white noise) by another sound (sinusoidal or filtered white noise).

Figure 5:
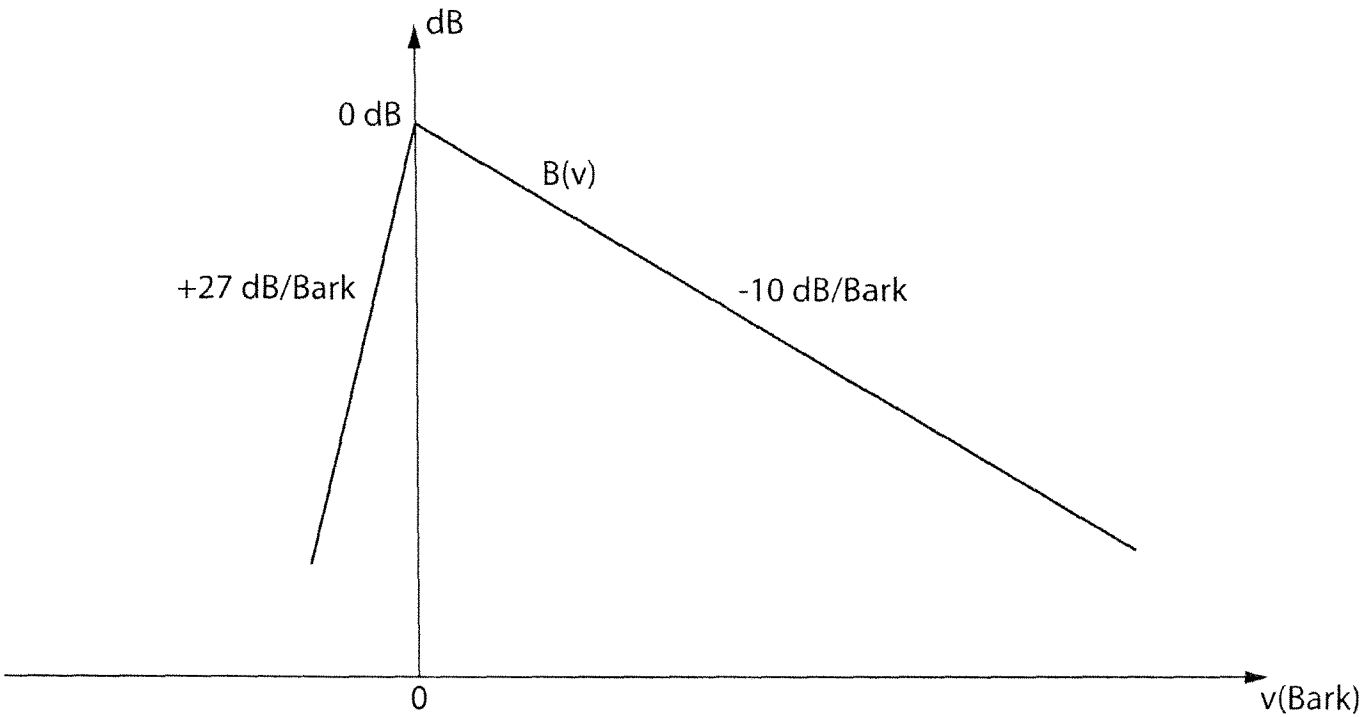
FIG. 5 shows an advantageous spread function for masking with the meaning of the invention.

An example of such a spread function is shown in FIG. 5. This function is defined in a frequency domain, the unit of which is the Bark. The frequency scale represents the frequency sensitivity of the ear. A usual approximation of the conversion of a frequency f in Hertz, into "frequencies" denoted v (in Barks), is given by the following relationship:

$$\upsilon = 13 \cdot \arctan(0.00076 \cdot f) + 3.5 \cdot \arctan\left(\left(\frac{f}{7500}\right)^2\right)$$

In this document, computation of the masking threshold is carried out per sub-band rather than per line. The threshold thus obtained is used for perceptually weighting each of the sub-bands. The bit allocation is thus carried out, not by minimizing the root mean square deviation, but by minimizing the "coding noise to mask" ratio, with the aim of shaping the coding noise so that it is inaudible (below the masking threshold).

Of course, other masking models have also been proposed. Typically, the spread function can be a function of the amplitude of the line and/or the frequency of the masking line. Detection of the "peaks" can also be implemented.

It is appropriate to point out that in order to reduce the sub-optimal nature of the coding according to standard G.729.1, consideration can be given to integrating a frequency masking technique in the bit allocation, in a similar fashion to that described in the document by Mahieux et al. However, the heterogeneous nature of the two signals, low band and high band, prevents direct application of the full-band masking technique of this document. On the one hand, the full-band masking threshold cannot properly be computed in the MDCT domain, as the low-band signal is not homogeneous with an "original" signal. On the other hand, applying a masking threshold on the whole frequency band would result in weighting once again the low-band signal which has already been weighted by the $\hat{A}(z/\gamma 1)/\hat{A}(z/\gamma 2)$ type filter, the additional threshold weighting then being superfluous for this low-band signal.

An application of the invention described hereafter makes it possible to improve the TDAC coding of the encoder according to standard G.729.1, in particular by applying a perceptual weighting of the high band (4 to 7 kHz) whilst ensuring spectral continuity between low and high bands for a satisfactory joint coding of these two bands.

In an encoder and/or a decoder according to standard G.729.1, enhanced by the implementation of the invention, only the TDAC coder and decoder are modified in the example described hereafter.

The input signal is sampled at 16 kHz, having a useful band 50 Hz to 7 kHz. In practice the coder still operates at the maximum bit rate of 32 kbit/s, while the decoder is able to receive the core (8 kbit/s) as well as one or more enhancement layers (12-32 kbit/s in steps of 2 kbit/s), as in standard G.729.1. The coding and decoding have the same architecture as that shown in FIGS. 1 and 2. Here, only blocks 110 and 203 are modified as described in FIGS. 6 and 7.

Figure 1:
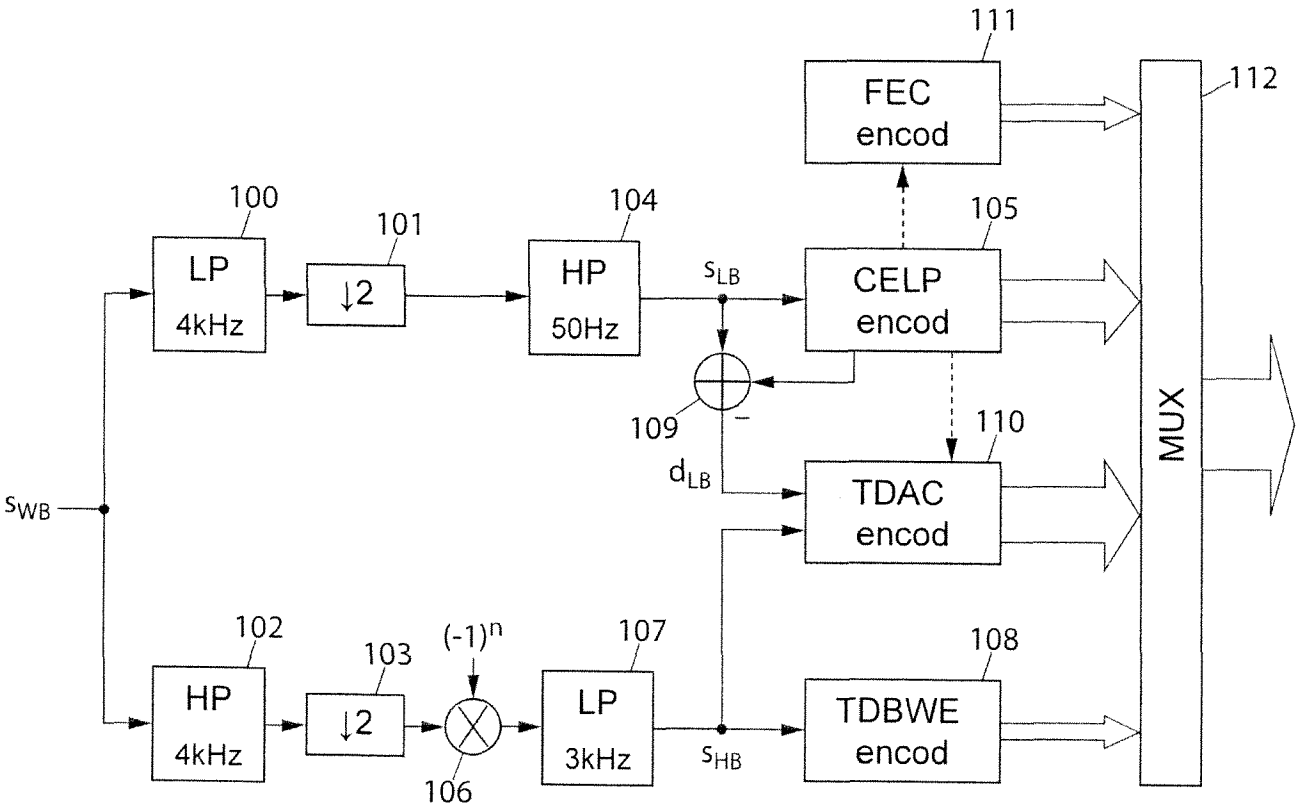
FIG. 1 shows the G.729.1 coder as a block diagram.
Figure 2:
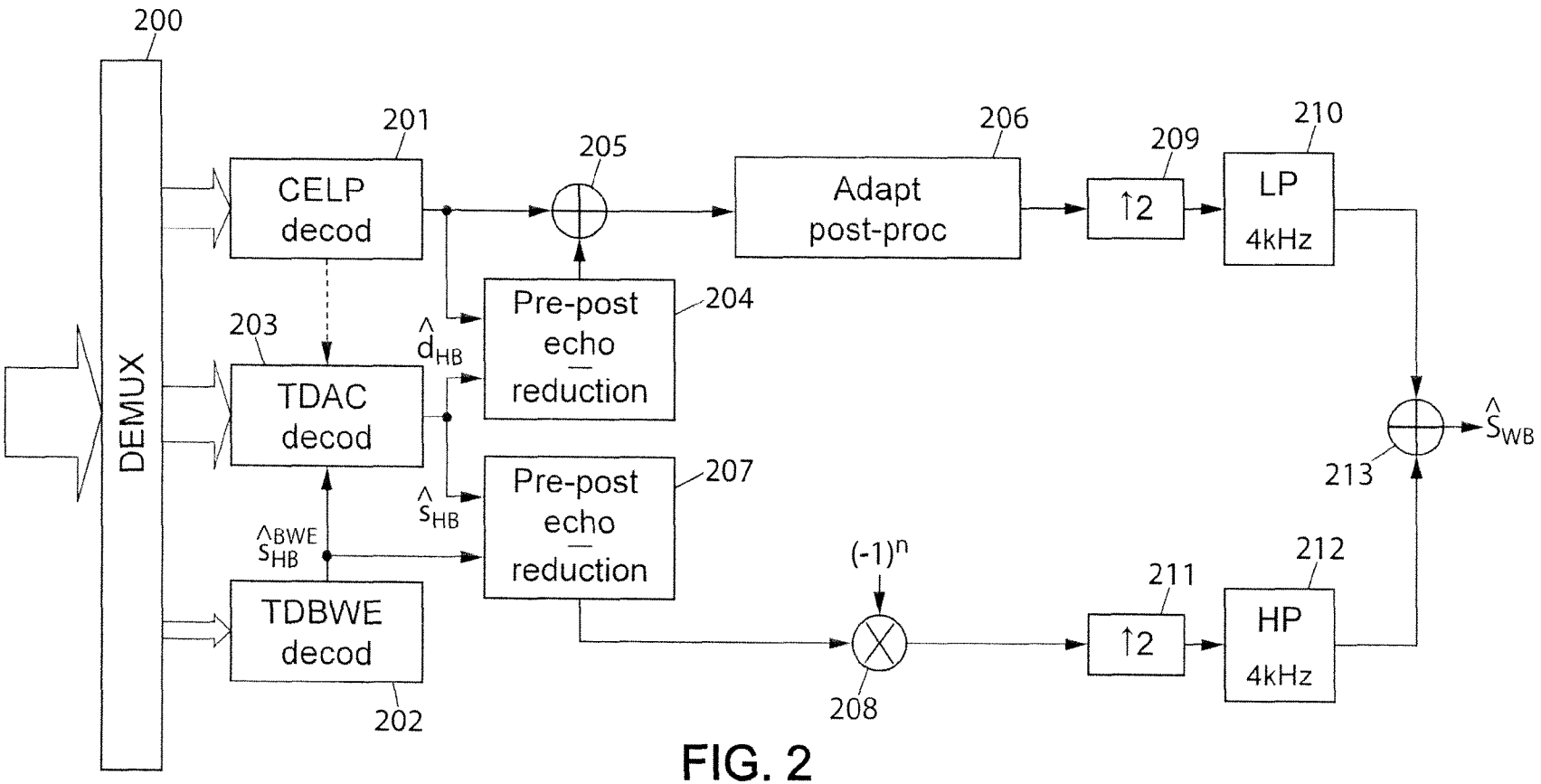
FIG. 2 shows the corresponding decoder according to standard G.729.1 as a block diagram.
Figure 3:
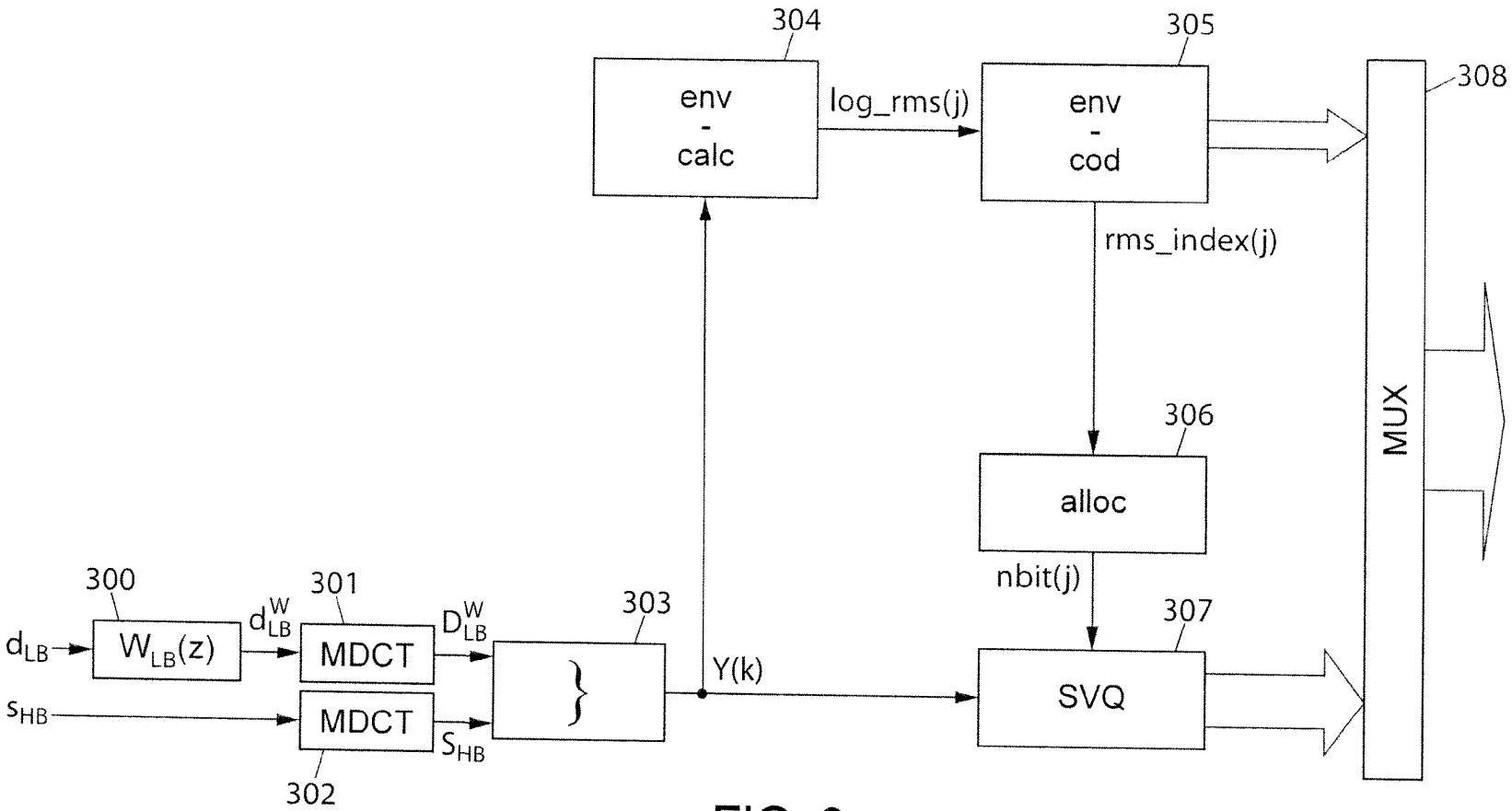
FIG. 3 shows the TDAC type transform coding in the G.729.1 coder as a block diagram.
Figure 6:
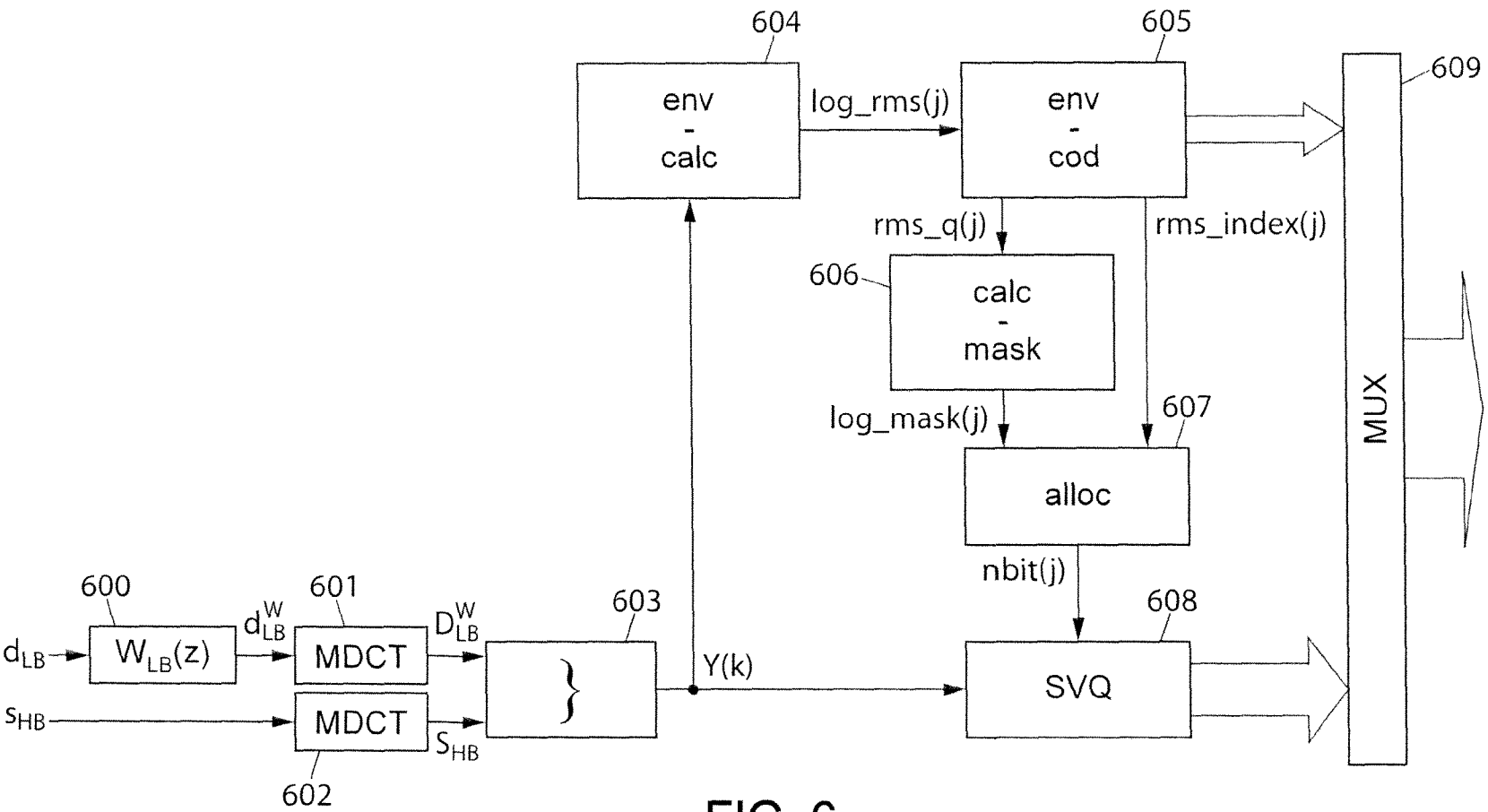
FIG. 6 shows, in comparison with FIG. 3, the structure of a TDAC encoding using a masking curve computation 606 for the allocation of bits according to a first embodiment of the invention.

In a first embodiment described hereafter with reference to FIG. 6, the modified TDAC coder is identical to that in FIG. 3, with the exception that the bit allocation following the root mean square deviation (block 306) is henceforth replaced by a masking curve computation and a modified bit allocation (blocks 606 and 607), the invention being included within the framework of the masking curve computation (block 606) and its use in the allocation of bits (block 607).

Figure 7:
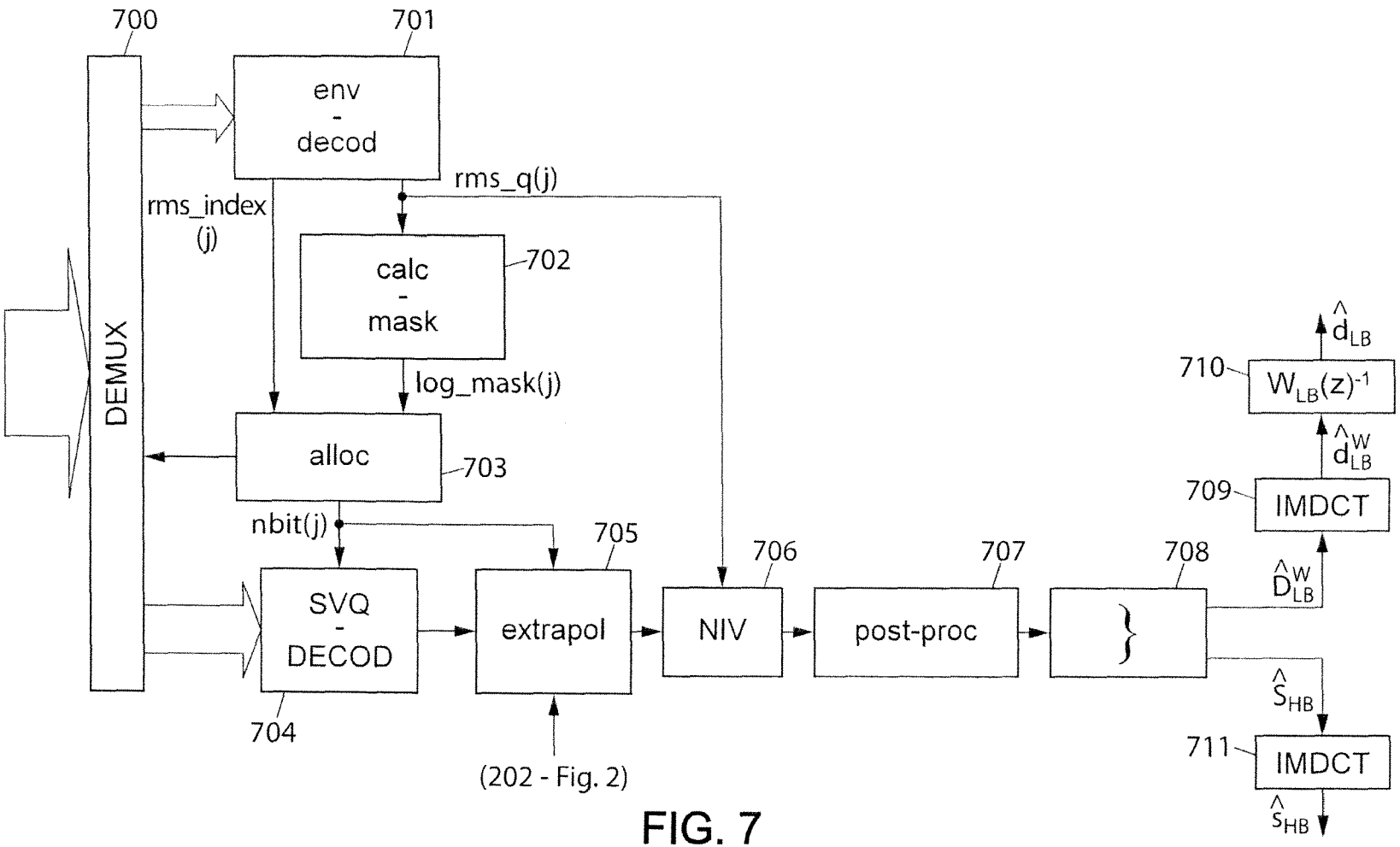
FIG. 7 shows, in comparison with FIG. 4, the structure of a TDAC decoding similar to FIG. 6, using a masking curve computation 702 according to the first embodiment of the invention.

Similarly, the modified TDAC decoder is shown in FIG. 7 in this first embodiment. This decoder is identical to that in FIG. 4, with the exception that the bit allocation following the root mean square deviation (block 402) is replaced by a masking curve computation and a modified bit allocation (blocks 702 and 703). In a symmetrical fashion to the modified TDAC coder, the invention relates to blocks 702 and 703.

Blocks 606 and 702 carry out an identical operation on the basis of the values rms_index(j), j=0, . . . , 17. Similarly, blocks 607 and 703 carry out an identical operation on the basis of the values log_mask(j) and rms_index(j), j=0, . . . , 17.

Thus only the operation of blocks 606 and 607 is described below.

Block 606 computes a masking curve based on the quantized spectral envelope rms_q(j) where j=0, . . . , 17 is the number of the sub-band.

The masking threshold M(j) of the sub-band j is defined by the convolution of the energy envelope $\hat{\sigma}^2(j)=\text{rms_q}(j)^2\times\text{nb_coef}(j)$, by a spread function B(v). In the embodiment given here of the TDAC coding in the encoder G.729.1, this masking is carried out only on the high band of the signal, with:

$$M(j)=\sum_{k=10}^{17}\hat{\sigma}^2(k)\times B(v_j-v_k)$$

where $v_k$ is the central frequency of the sub-band k in Bark, the sign "×" denotes "multiplied by", with the spread function described hereafter.

In more generic terms, the masking threshold M(j), for a sub-band j, is therefore defined by a convolution between:

a spectral envelope expression, and a spread function involving a central frequency of the sub-band j.

An advantageous spread function is that shown in FIG. 5. This is a triangular function, the first gradient of which is +27 dB/Bark and the second −10 dB/Bark. This representation of the spread function allows the following iterative computation of the masking curve:

$$M(j)=\begin{cases} M^-(10) & j=10 \\ M^+(j)+M^-(j)+\hat{\sigma}^2(j) & j=1,\ldots,16 \\ M^+(17) & j=17 \end{cases}$$

where $$M^+(j)=\hat{\sigma}^2(j-1)\cdot\Delta_2(j)+M^+(j-1)\cdot\Delta_2(j)\quad j=11,\ldots,17$$

$$M^-(j)=\hat{\sigma}^2(j+1)\cdot\Delta_1(j)+M^-(j+1)\cdot\Delta_1(j)\quad j=10,\ldots,16$$

and $$\Delta_2(j)=10^{\frac{-10}{10}(v_j-v_{j-1})}$$

$$\Delta_1(j)=10^{\frac{27}{10}(v_j-v_{j+1})}$$

The values of $\Delta_1(j)$ and $\Delta_2(j)$ can be pre-computed and stored.

A first embodiment of application of the invention to bit allocation in a hierarchical coder such as the G.729.1 encoder is described hereafter.

The bit allocation criterion is here based on the signal-to-mask ratio given by:

$$\frac{1}{2}\log_2\left(\frac{\hat{\sigma}^2(j)}{M(j)}\right)$$

As the low band is already perceptually filtered, the application of the masking threshold is restricted to the high band. In order to ensure spectral continuity between the low band spectrum and the high band spectrum weighted by the masking threshold and in order to avoid biasing the bit allocation, the masking threshold is normalized by its value on the last sub-band of the low band.

The perceptual importance is therefore redefined as follows:

$$ip(j)=\begin{cases} \frac{1}{2}\log_2(\hat{\sigma}^2(j))+\text{offset} & \text{for } j=0\ldots 9 \\ \frac{1}{2}\left[\log_2\left(\frac{\hat{\sigma}^2(j)}{M(j)}\right)+normfac\right]+\text{offset} & \text{for } j=10\ldots 17 \end{cases}$$

where offset=−2 and norm ac is a normalization factor computed according to the relationship:

$$normfac=\log_2\left[\sum_{j=9}^{17}\hat{\sigma}^2(j)\times B(v_9-v_j)\right]$$

It is noted that the perceptual importance ip(j), j=0, . . . , 9, is identical to that defined in standard G.729.1. On the other hand, the definition of the term ip(j), j=10, . . . , 17, has changed.

The perceptual importance redefined above is now written:

$$ip(j) = \begin{cases} \frac{1}{2}\text{rms_index}(j) & \text{for } j = 0, \ldots, 9 \\ \frac{1}{2}[\text{rms_index}(j) - \text{log_mask}(j)] & \text{for } j = 10, \ldots, 17 \end{cases}$$

where log_mask(j)=$\log_2$ (M(j))-normfac.

It will be understood that the second line of the bracket for computation of the perceptual importance is an expression of implementation of the invention according to this first application to the allocation of bits in a transform coding as upper layer of a hierarchical coder.

Figure 8:
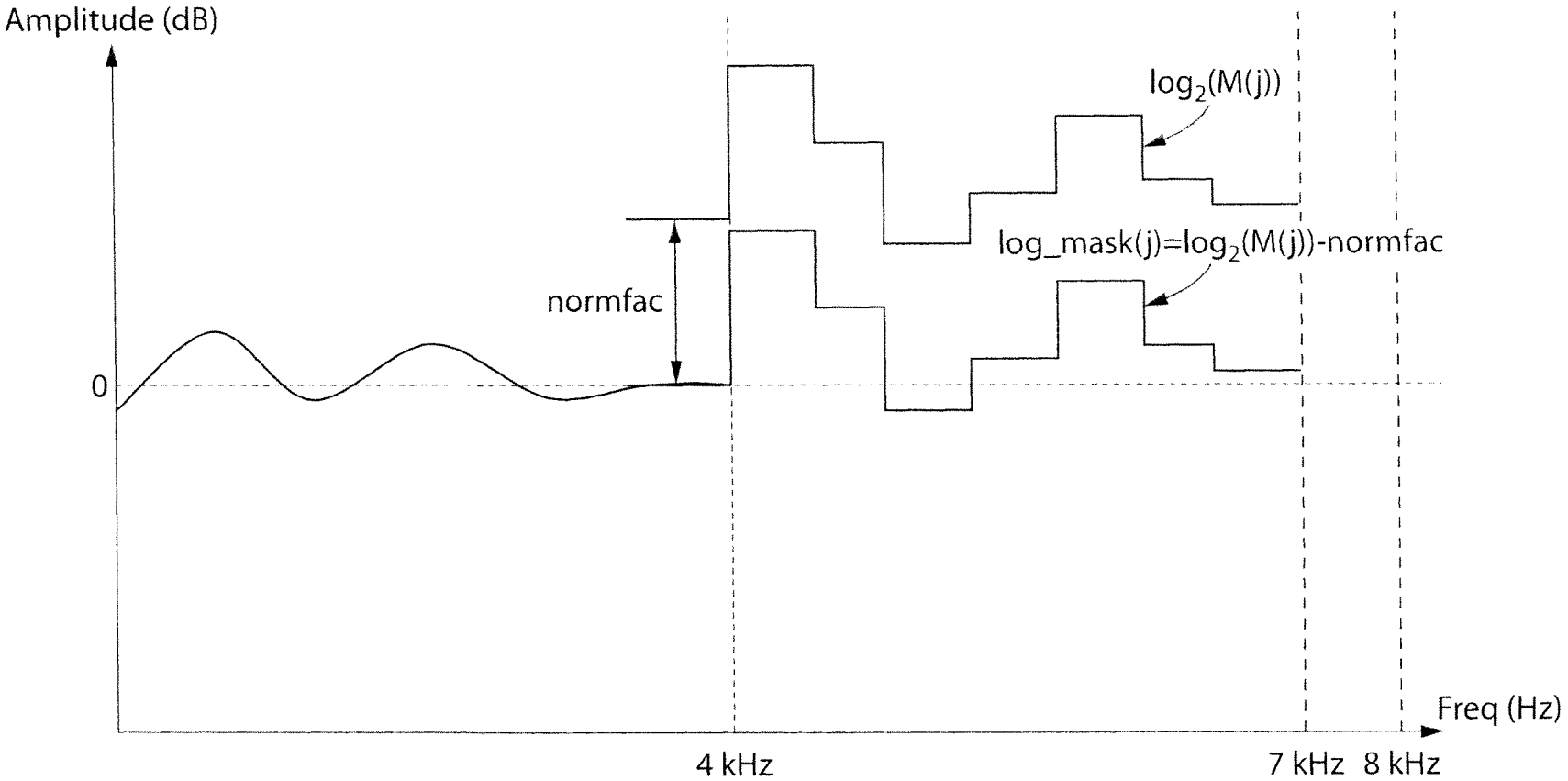
FIG. 8 shows a normalization of the masking curve, in a first embodiment where the sampling frequency is 16 kHz, and the masking of the invention applied for the 4-7 kHz high band.

An illustration of the normalization of the masking threshold is given in FIG. 8, showing the connection of the high band, on which the masking (4-7 kHz) is applied, to the low band (0-4 kHz).

Blocks 607 and 703 then carry out the bit allocation computations:

$$nbit(j) = \arg_{r \in R} \min_{nb_coef(j)} |\text{nb_coef}(j) \times (ip(j) - \lambda_{opt}) - r|$$

where $\lambda_{opt}$ is obtained by dichotomy as in standard G.729.1.

The only difference compared to blocks 307 and 402 of the prior art is therefore the definition of the perceptual importance ip(j) for the sub-bands of the high band.

In a variant of this embodiment where the normalization of the masking threshold is carried out in relation to its value on the last sub-band of the low band, the normalization of the masking threshold can rather be carried out on the basis of the value of the masking threshold in the first sub-band of the high band, as follows:

$$normfac = \log_2\left[\sum_{j=10}^{17} \hat{\sigma}^2(j) \times B(v_{10} - v_j)\right].$$

In yet another variant, the masking threshold can be computed over the whole of the frequency band, with:

$$M(j) = \sum_{k=0}^{17} \hat{\sigma}^2(k) \times B(v_j - v_k)$$

The masking threshold is then applied only to the high band after normalization of the masking threshold by its value over the last sub-band of the low band:

$$normfac = \log_2\left[\sum_{j=0}^{17} \hat{\sigma}^2(j) \times B(v_9 - v_j)\right],$$

or also by its value over the first sub-band of the high band:

$$normfac = \log_2\left[\sum_{j=0}^{17} \hat{\sigma}^2(j) \times B(v_{10} - v_j)\right]$$

Of course, these relationships giving the normalization factor normfac or the masking threshold M(j) can be generalized to any number of sub-bands (different, in total, from eighteen) both high-band (with a number different from eight), and low-band (with a number different from ten).

Figure 12:
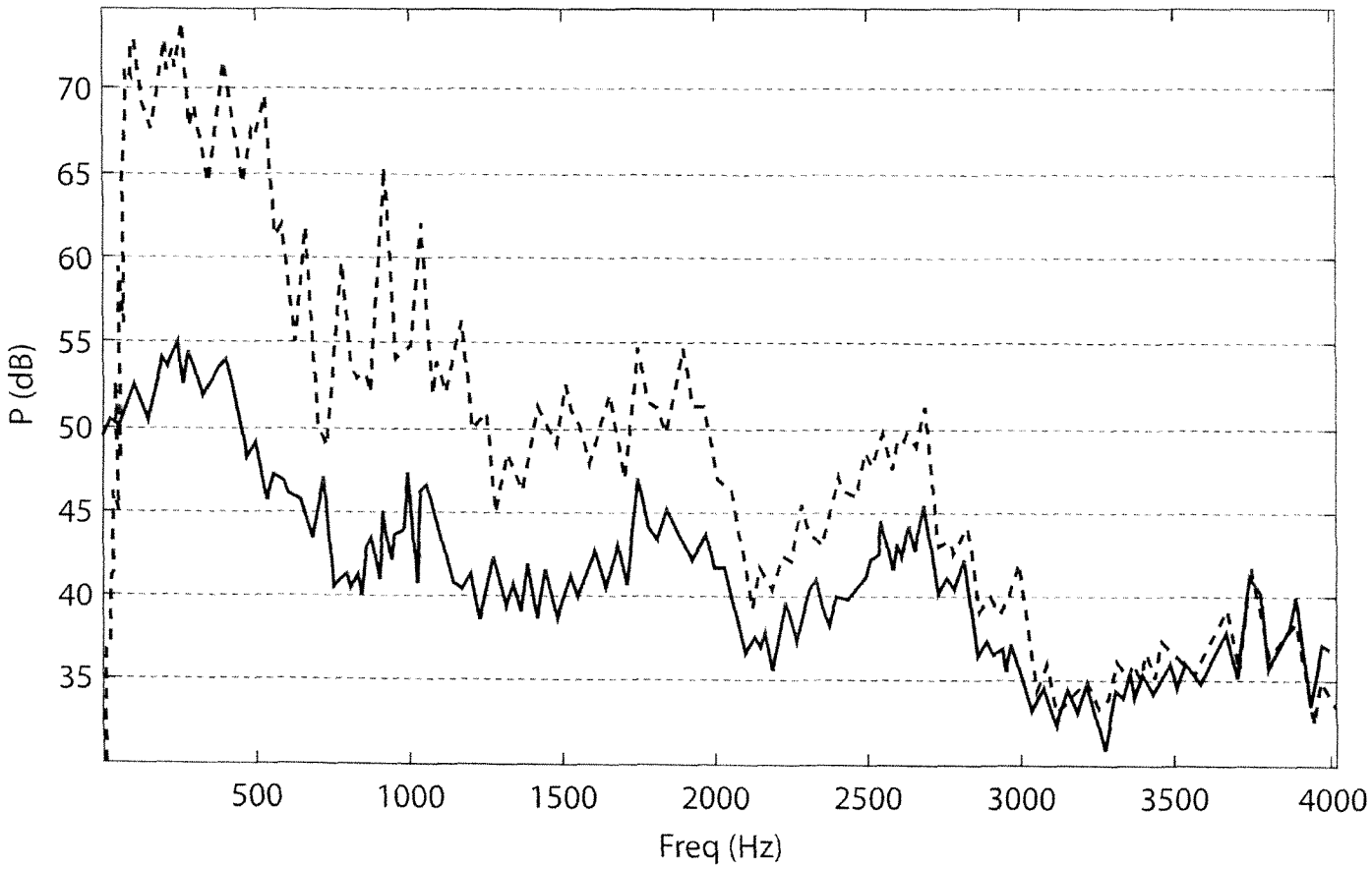
FIG. 12 shows the spectral power at the output of the CELP coding, of the difference signal $D_{LB}$ (in solid line) and the original signal $S_{LB}$ (in broken line).

In general terms, it will also be disclosed that energy continuity is sought between the high band and the low band, whilst using to this end the perceptually weighted low-band difference signal, $d_{LB}^{W}$, and not the original signal itself. In reality, as shown in FIG. 12, the CELP coding on the difference signal (solid line curve) at the end of the low band (after 2700 Hz, typically), gives an energy level very close to the original signal itself (broken line curve). As in the G.729.1 coding, only the perceptually weighted signal difference is available in the low band; this observation is used to determine the high-band masking normalization factor.

In a second embodiment, the normalized masking threshold is not used for weighting the energy in the definition of the perceptual importance, as in the first embodiment described above, but is used for directly weighting the high-band signal before TDAC coding.

Figure 9A:
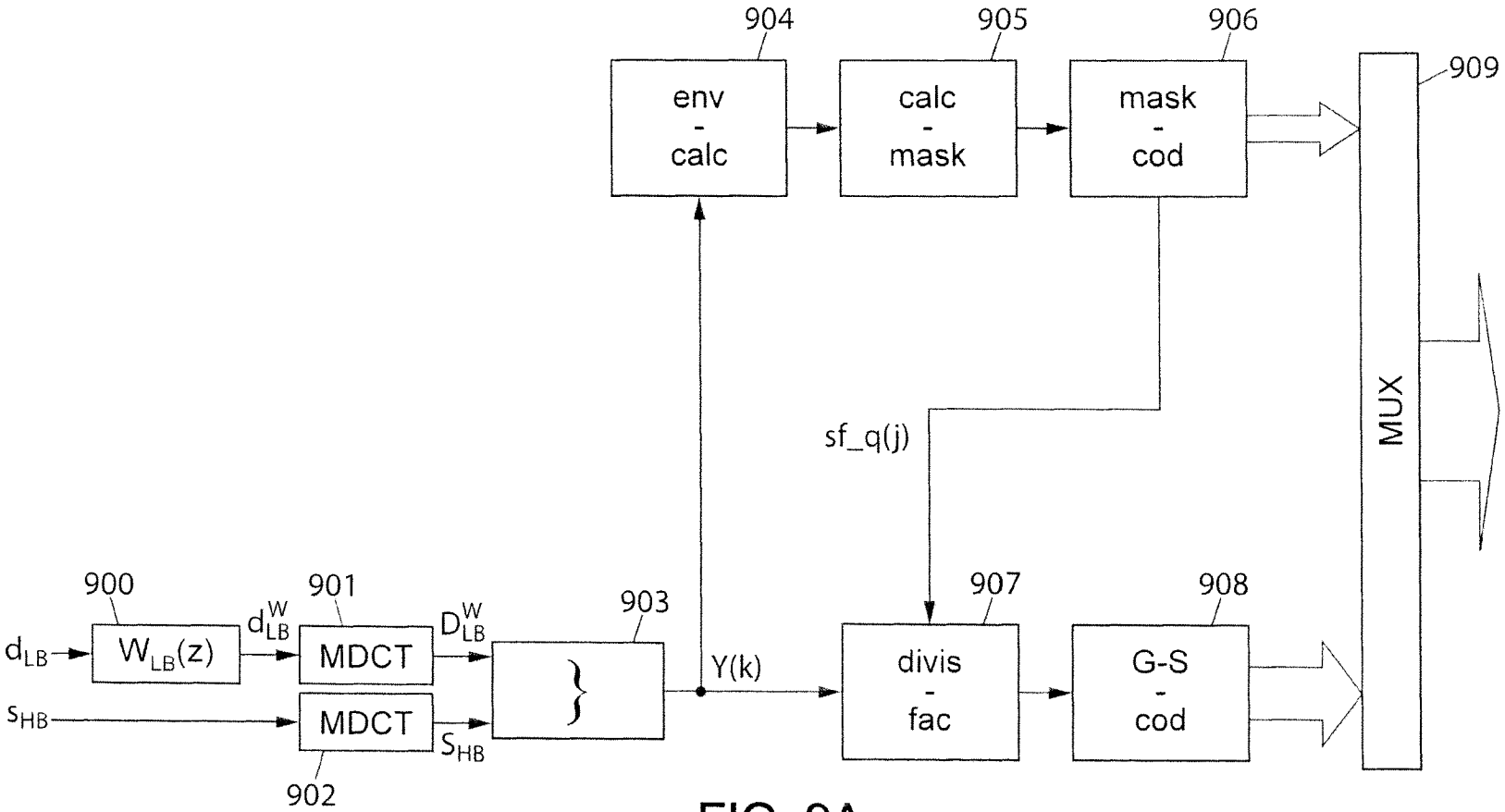
FIG. 9A shows the structure of a modified TDAC encoding, with direct weighting of the signal in the 4-7 kHz high frequencies in a second embodiment of the invention, and coding of the normalized masking threshold.

This second embodiment is shown in FIGS. 9A (for the encoding) and 10A (for the decoding). A variant of this second embodiment, to which the present invention relates in particular for the decoding carried out, is shown in FIGS. 9B (for the encoding) and 10B (for the decoding).

Figure 9B:
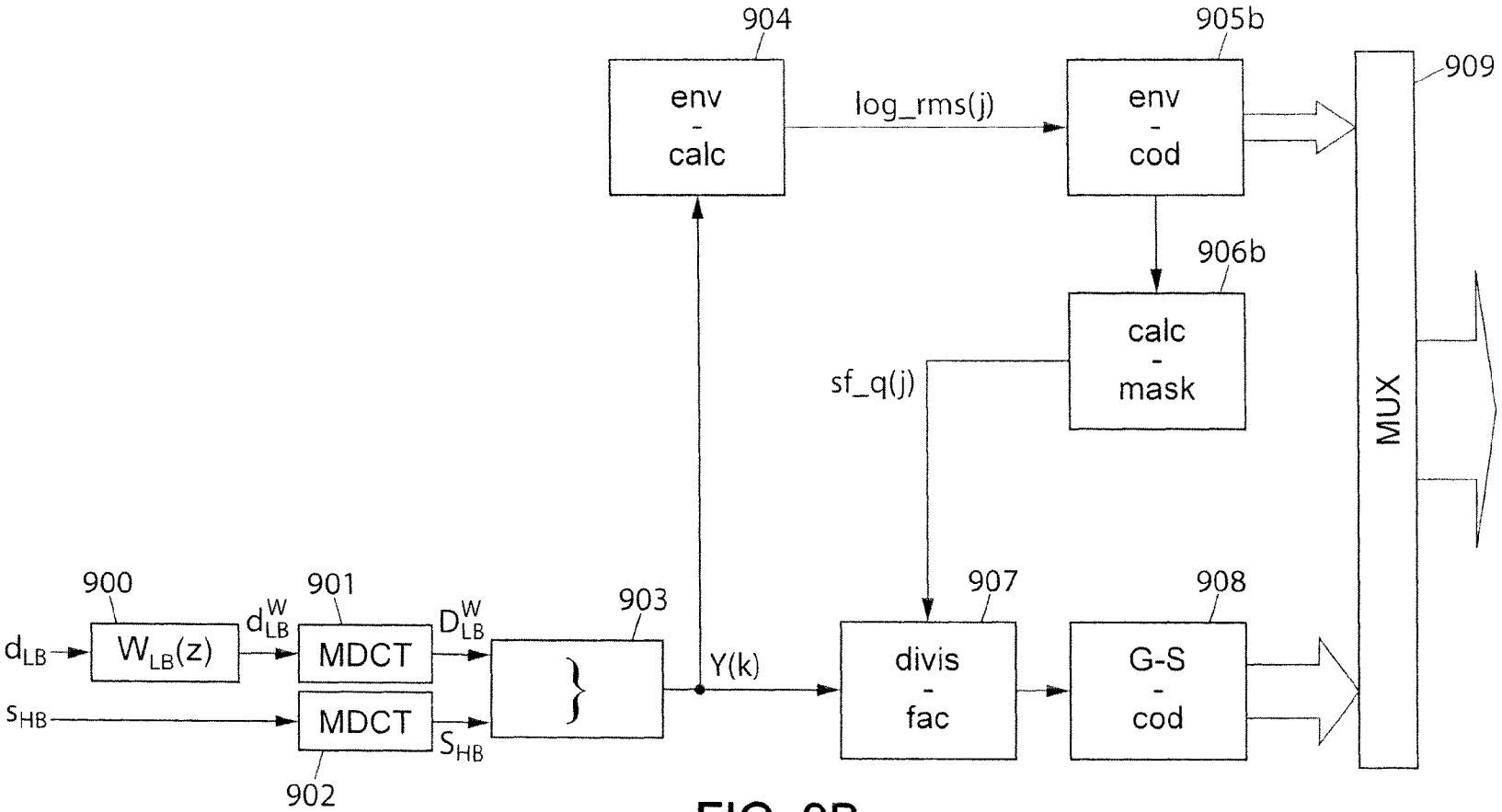
FIG. 9B shows the structure of a TDAC encoding in a variant of the second embodiment shown on FIG. 9A, here with coding of the spectral envelope.

In FIGS. 9A and 9B, the spectrum Y(k) coming from block 903 is split into eighteen sub-bands and the spectral envelope is computed (block 904) as described previously.

On the other hand, the masking threshold is computed (block 905 in FIG. 9A and block 906*b* in FIG. 9B) on the basis of the non-quantized spectral envelope.

In the embodiment in FIG. 9A, information representing the weighting by the masking threshold M(j) is encoded directly, rather than coding the spectral envelope. In practice, in this embodiment, the scale factors sf(j) are coded only from j=10 up to j=17.

In fact, the scale factors are given by:

sf(j)=1, for j=0, . . . , 9, on the low band, and by the square root of the normalized masking threshold M(j), for the high band, i.e. sf(j)=$\sqrt{M(j)}$, for j=10, . . . , 17.

Thus, it is not necessary to code the scale factors for j=0, . . . , 9 and the scale factors are only coded for j=10, . . . , 17.

Still referring to FIG. 9A, the information corresponding to the scale factors sf(j), for j=10, . . . , 17, can be encoded (block 906) by an envelope coding technique of the same type as that used in the G.729.1 encoder (block 305 in FIG. 3), for example by scalar quantization followed by a differential Huffman coding for the high-band portion.

The spectrum Y(k) is then divided (block 907) by the decoded scale factors, sf_q(j), j=0, . . . , 17 before "gain-shape" type coding. This coding is carried out by algebraic quantization using root mean square deviation, as described in the document by Ragot and al:

"*Low-complexity multi-rate lattice vector quantization with application to wideband TCX speech coding at* 32 *kbit/s*", S. Ragot, B. Bessette, and R. Lefebvre, Proceedings ICASSP-Montreal (Canada), Pages: 501-504, vol. 1 (2004).

This gain-shape type quantization method is implemented in particular in standard 3GPP AMR-WB+.

Figure 10A:
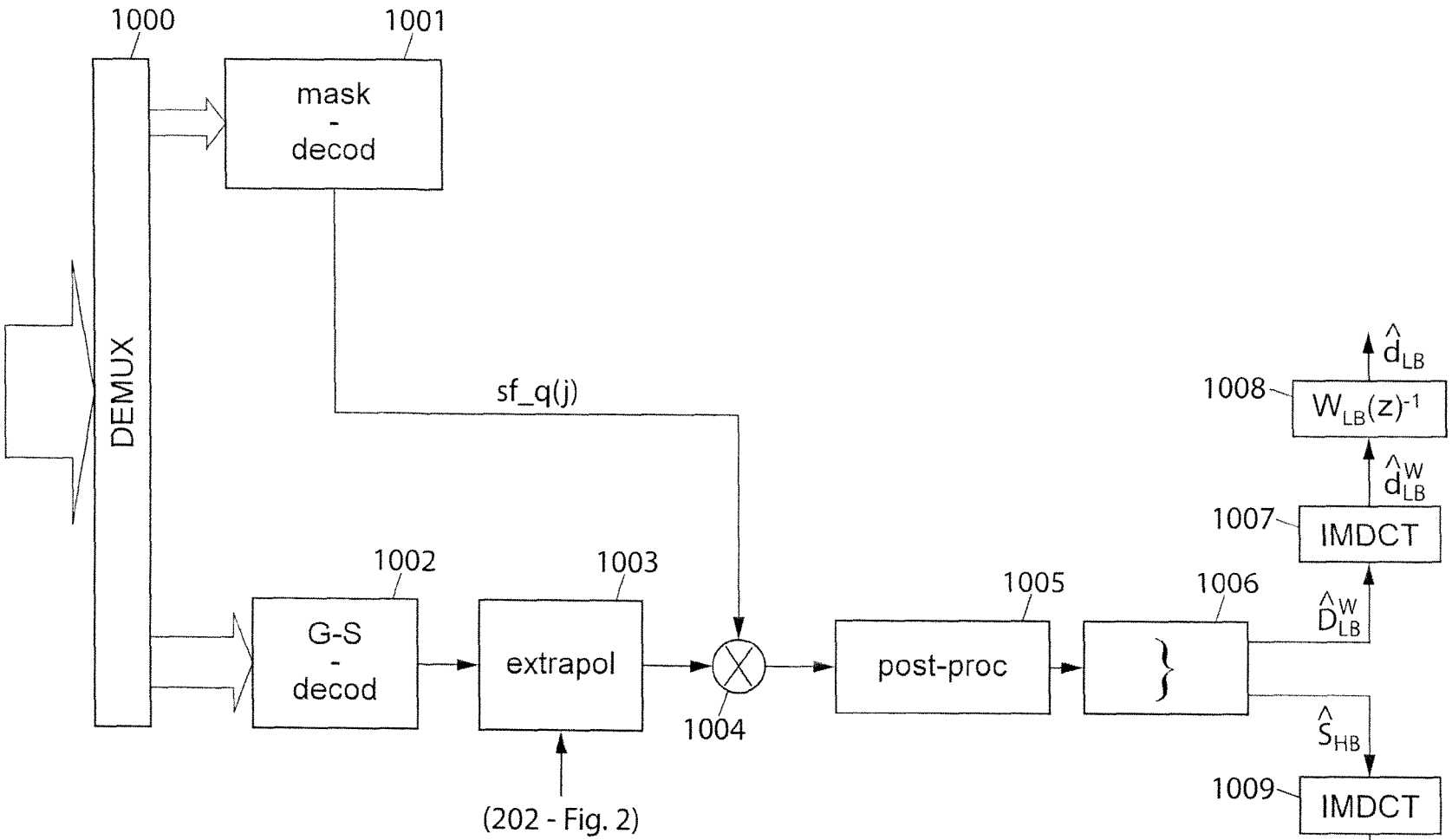
FIG. 10A shows the structure of a TDAC decoding similar to FIG. 9A, according to the second embodiment of the invention.

The corresponding decoder is shown in FIG. 10A. The scale factors sf_q(j), j=0, . . . , 17, are decoded in block 1001. Block 1002 is then realized as described in the above-mentioned document by Ragot et al.

Figure 4:
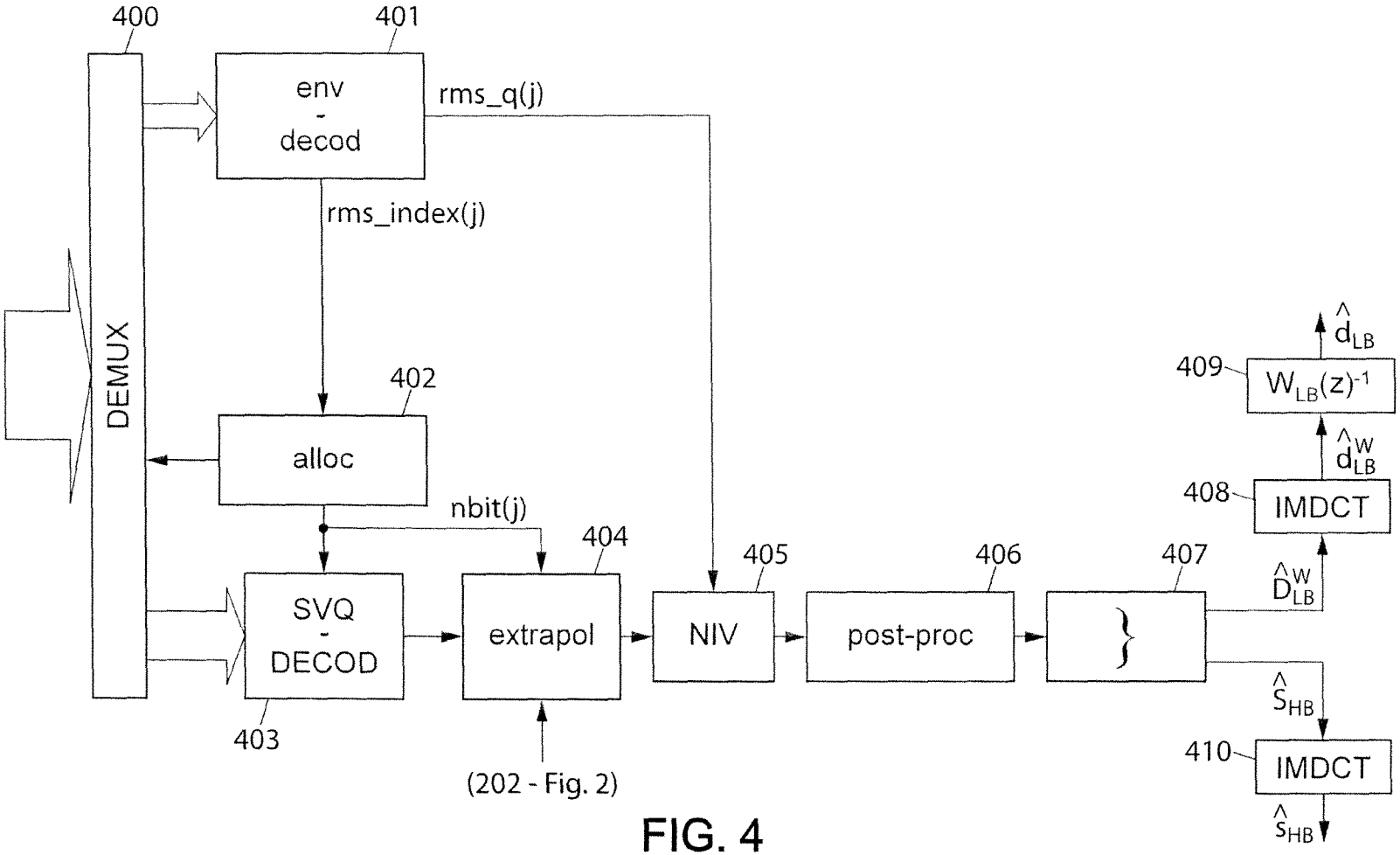
FIG. 4 shows the stage of TDAC type transform decoding in the decoder G.729.1 as a block diagram.

Extrapolation of the missing sub-bands (block 1003 in FIG. 10A) follows the same principle as in the G.729.1 decoder (block 404 in FIG. 4). Thus, if a decoded sub-band comprises zeros only, the spectrum decoded by the band expansion then replaces this sub-band.

Block 1004 also carries out a similar function to that of block 405 in FIG. 4. However, the scale factors sf_q(j), j=0, . . . , 17, are used instead of the decoded spectral envelope, rms_q(j), j=0, . . . , 17.

This second embodiment can prove particularly advantageous, in particular in an implementation according to standard 3GPP-AMR-WB+ which is presented as the preferred environment of the above-mentioned document by Ragot et al.

Figure 10B:
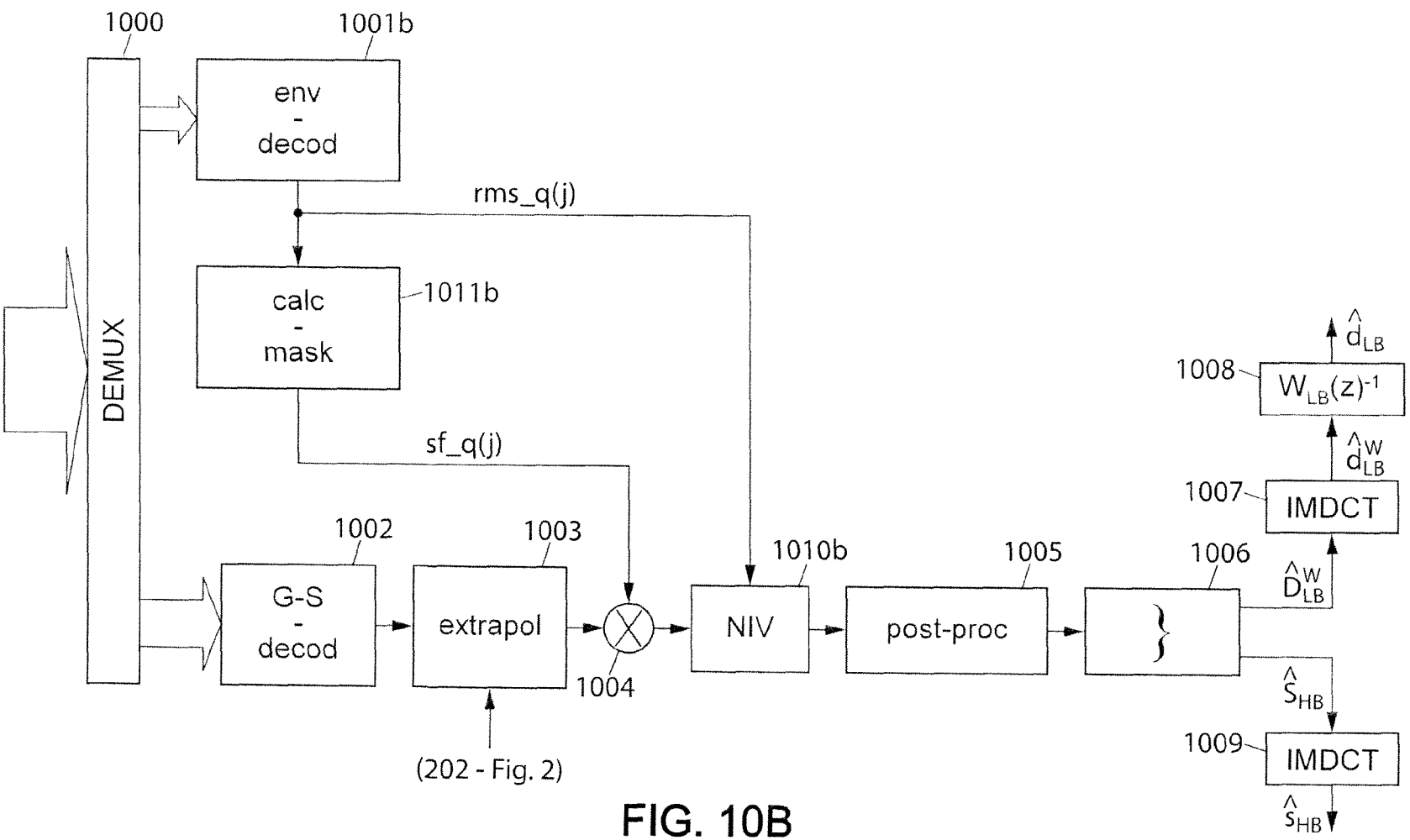
FIG. 10B shows the structure of a TDAC decoding similar to FIG. 9B, according to the second embodiment of the invention, here with a computation of the masking threshold at decoding.

In a variant of this second embodiment, as shown in FIGS. 9B and 10B (the same references in FIGS. 9A and 9B, and 10A and 10B, denote the same elements), the coded information remains the energy envelope (rather than the masking threshold itself such as in FIGS. 9A and 10A).

On coding, the masking threshold is computed and normalized (block 906*b* in FIG. 9B) on the basis of the coded spectral envelope (block 905*b*). On decoding, the masking threshold is computed and normalized (block 1011*b* in FIG. 10B) on the basis of the decoded spectral envelope (block 1001*b*), the decoding of the envelope making it possible to carry out a level adjustment (block 1010*b* in FIG. 10B) on the basis of the quantized values rms_q(j).

Thus, in case of zero decoded sub-bands, it is advantageously possible, in this variant, to carry out an extrapolation and to maintain a correct decoded signal level.

In general terms, in the first embodiment as in the second, it will be understood that a masking threshold is computed for each sub-band, at least for the sub-bands of the high-frequency band, this masking threshold being normalized to ensure a spectral continuity between the sub-bands in question.

It is also indicated that the computation of a frequency masking within the meaning of the invention can be carried out or not according to the signal to be coded (in particular if is tonal or not).

In fact it has been noted that computation of the masking threshold is particularly advantageous when the signal to be coded is not tonal, in both the above-described first and second embodiments.

If the signal is tonal, the application of the spread function B(v) results in a masking threshold very close to a tone having a slightly wider frequency spread. The allocation criterion minimizing the coding noise-to-mask ratio then gives a quite mediocre bit allocation. The same applies for direct weighting of the high-band signal according to the second embodiment. It is therefore preferable, for a tonal signal, to use a bit allocation according to energy criteria. Thus, preferably, the invention is only applied if the signal to be coded is not tonal.

In generic terms, information is thus obtained (from block 305) according to which the signal to be coded is tonal or not tonal, and the perceptual weighting of the high band, with determination of the masking threshold and the normalization, are only performed if the signal is not tonal.

Implementation of this observation will now be described in an encoder according to standard G.729.1. The bit relating to the coding mode of the spectral envelope (block 305 in FIG. 3 in particular) indicates a "differential Huffman" mode or a "direct natural binary" mode. This mode bit can be interpreted as a detection of tonality as, in general, a tonal signal leads to an envelope coding by the "direct natural binary" mode, while most of the non-tonal signals, having a more limited spectral dynamic, lead to envelope coding by the "differential Huffman" mode.

Thus, a benefit can be gained from the "signal tonality detection" in order to implement the invention or not. More particularly, the invention is applied in the case where the spectral envelope was coded in "differential Huffman" mode and the perceptual importance is then defined within the meaning of the invention, as follows:

$$ip(j) = \begin{cases} \frac{1}{2}\text{rms_index}(j) & \text{for } j = 0 \ldots 9 \\ \frac{1}{2}[\text{rms_index}(j) - \text{log_mask}(j)] & \text{for } j = 10 \ldots 17 \end{cases}$$

On the other hand, if the envelope was coded in "direct natural binary" mode, the perceptual importance remains as defined in standard G.729.1:

$$ip(j) = \begin{cases} \frac{1}{2}\text{rms_index}(j) & \text{for } j = 0, \ldots, 16 \\ \frac{1}{2}(\text{rms_index}(j) - 1) & \text{for } j = 17 \end{cases}$$

It is indicated that in the second embodiment, the module 904 in FIG. 9A can determine, by computing the spectral envelope, if the signal is tonal or not and thus block 905 is bypassed in the affirmative. Similarly, for the embodiment described in FIG. 9B, the module 904 can make it possible to determine if the signal is tonal or not and thus bypass block 907 in the affirmative.

A possible application of the invention to an expansion of the G.729.1 encoder will now be described, in particular in super wideband.

Figure 11:
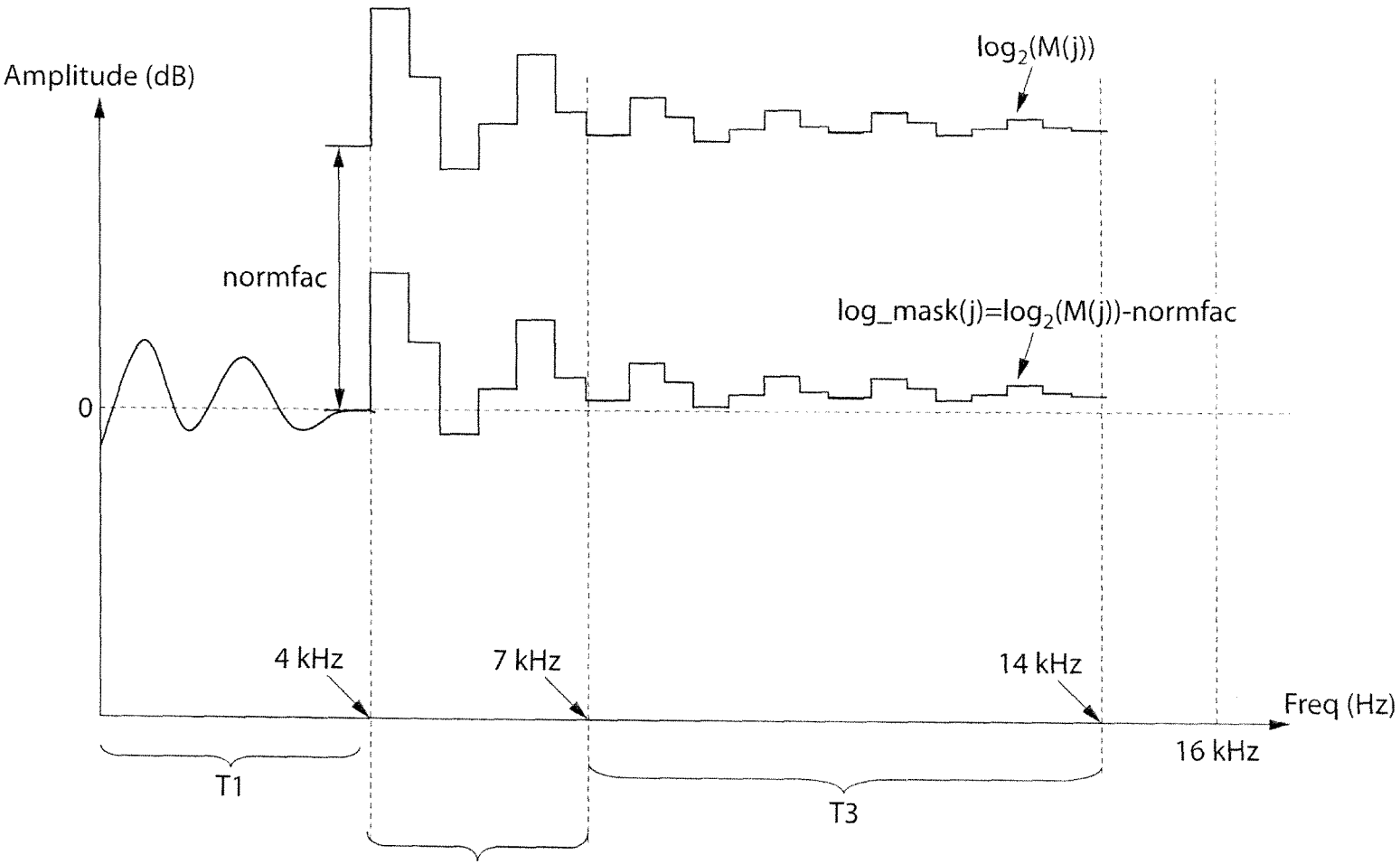
FIG. 11 shows the normalization of the masking curve in super wideband in a second embodiment of the invention, where the sampling frequency is 32 kHz, and the masking of the invention applied for the super wideband from 4-14 kHz.

FIG. 11 generalizes the normalization of the masking curve (described in FIG. 8) in the case of super wideband coding. In this embodiment, the signals are sampled at a frequency of 32 kHz (instead of 16 kHz) for a useful band of 50 Hz-14 kHz. The masking curve $\log_2[M(j)]$ is then defined at least for sub-bands ranging from 7 to 14 kHz.

In fact, the spectrum covering the 50 Hz-14 kHz band is coded by sub-bands and the bit allocation to each sub-band is realized on the basis of the spectral envelope as in the G.729.1 encoder. In this case, a partial masking threshold can be computed as described previously.

The normalization of the masking threshold, as shown in FIG. 11, is thus also generalized to the case where the high band comprises more sub-bands or covers a wider frequency zone than that in standard G.729.1.

With reference to FIG. 11, over the low band between 50 Hz and 4 kHz, a first transform T1 is applied to the time-weighted difference signal. A second transform T2 is applied to the signal over the first high band between 4 and 7 kHz and a third transform T3 is applied to the signal over the second high band between 7 and 14 kHz.

Thus it will be understood that the invention is not limited to signals sampled at 16 kHz. Its implementation is also particularly advantageous for signals sampled at higher frequencies, such as for the expansion of the encoder according to standard G.729.1 to signals no longer sampled at 16 kHz but at 32 kHz, as described above. If the TDAC coding is generalized to such a frequency band (50 Hz-14 kHz instead of 50 Hz-7 kHz currently), the advantage achieved by the invention will be substantial.

In fact, in the frequency range 4-14 kHz, the limits of the root mean square deviation criterion become really prohibitive and in order for the bit allocation to remain quasi-optimal, a perceptual weighting using the frequency masking within the meaning of the invention proves very advantageous.

Thus, the invention also relates to improving the TDAC coding, in particular by applying a perceptual weighting of the expanded high band (4-14 kHz) while ensuring the spectral continuity between bands; this criterion being important for joint coding of the first low band and the second high band extended up to 14 kHz.

An embodiment was described above in which the low band was always perceptually weighted. This embodiment is in no way necessary for implementation of the invention. In a variant, the hierarchical coder is implemented with a core coder in a first frequency band, and the error signal associated with this core coder is transformed directly, without perceptual weighting in this first frequency band, in order to be coded in conjunction with the transformed signal of a second frequency band. By way of example, the original signal can be sampled at 16 kHz and split into two frequency bands (from 0 to 4000 Hz and from 4000 to 8000 Hz) by a suitable filterbank of the QMF type. In such an embodiment the coder can be typically be a coder according to standard G.711 (with PCM compression). The transform coding is then carried out on:

- the difference signal between the original signal and the G.711 synthesis in the first frequency band (0-4000 Hz), and
- the original signal, perceptually weighted in the frequency domain according to the invention, in a second frequency band (4000-8000 Hz).

Thus, in this embodiment, the perceptual weighting in the low band is not necessary for application of the invention.

In another variant, the original signal is sampled at 32 kHz and split into two frequency bands (from 0 to 8000 Hz and from 8000 to 16000 Hz) by a suitable filterbank of the QMF type. Here, the coder can be a coder according to standard G.722 (ADPCM compression in two sub-bands), and the transform coding is carried out on:

- the difference signal between the original signal and the G.122 synthesis in the first frequency band (0-8000 Hz), and
- the original signal, which is also perceptually weighted according to the invention in a frequency domain restricted to the second frequency band (8000-16000 Hz).

Finally, it is indicated that the present invention also relates to a first software program, stored in a memory of a coder of a telecommunications terminal and/or stored on a storage medium intended to cooperate with a reader of said coder. This first program then comprises instructions for the implementation of the coding method defined above, when these instructions are executed by a processor of the coder.

The present invention also relates to a coder comprising at least one memory storing this first software program.

It will be understood that FIGS. 6, 9A and 9B can constitute flow charts of this first software program, or also illustrate the structure of such a coder, according to different embodiments and variants.

The present invention also relates to a second software program, stored in a memory of a decoder of a telecommunications terminal and/or stored on a storage medium intended to cooperate with a reader of said decoder. This second program then comprises instructions for the implementation of the decoding method defined above, when these instructions are executed by a processor of the decoder.

The present invention also relates to a coder comprising at least one memory storing this second software program.

It will also be understood that FIGS. 7, 10A, 10B can constitute flow charts of this second software program, or also illustrate the structure of such a decoder, according to different embodiments and variants.

The invention claimed is:

1. A method of coding an audio signal in several sub-bands, in which at least one first and one second sub-bands which are adjacent are transform coded, wherein, in order to apply a perceptual weighting, in the transformed domain, at least to the second sub-band, the method comprises:

determining at least one frequency masking threshold to be applied on the second sub-band, the same threshold not being applied on the first sub-band, and normalizing said masking threshold in order to ensure a spectral continuity between said first and second sub-bands, to produce a coded audio signal.

2. A method according to claim 1, in which a number of bits to be allocated to each sub-band is determined on the basis of a spectral envelope, wherein the bit allocation for the second sub-band at least is determined moreover as a function of a normalized masking curve computation, applied at least to the second sub-band.

3. A method according to claim 2, in which the coding is carried out on more than two sub-bands, the first sub-band being included in a first spectral band and the second sub-band being included in a second spectral band, wherein the number of bits per sub-band nbit(j) is given, for each sub-band of index j, according to a perceptual importance ip(j) computed on the basis of a relationship of the type:

$$ip(j) = \frac{1}{2}\text{rms_index}(j),$$

if j is a sub-band index in the first band, and $$ip(j) = \frac{1}{2}[\text{rms_index}(j) - \text{log_mask}(j)],$$

if j is a sub-band index in the second band, with log_mask(j)= $\log_2$(M(j))-normfac, where:

$\text{rms}_{13}$ index(j) are quantized values originating from the coding of the envelope, for the sub-band j, M(j) is the masking threshold for said sub-band of index j, and normfac is a normalization factor determined to ensure spectral continuity between said first and second sub-bands.

4. A method according to claim 1, wherein the transformed signal, in the second sub-band, is weighted by a factor proportional to the square root of the normalized masking threshold for the second sub-band.

5. A method according to claim 4, in which the coding is carried out on more than two sub-bands, the first sub-band being included in a first spectral band and the second sub-band being included in a second spectral band, wherein weighting values of $\sqrt{M(j)}$ are coded, where M(j) is the normalized masking threshold for a sub-band of index j, included in the second spectral band.

6. A method according to claim 1, wherein the transform coding takes place in an upper layer of a hierarchical coder, the first sub-band comprising a signal originating from a core coding of the hierarchical coder, and the second sub-band comprising an original signal.

7. A method according to claim 6, wherein the signal originating from the core coding is perceptually weighted.

8. A method according to claim 6, wherein the signal originating from the core coding is a signal representing a difference between an original signal and a synthesis of this original signal.

9. A method according to claim 6, wherein the transform coding is of the TDAC type in an overall coder according to standard G.729.1, and the first sub-band is included in a low-frequency band, while the second sub-band is included in a high-frequency band.

10. A method according to claim 9, wherein the high-frequency band extends up to 7000 Hz, at least.

11. A method according to claim 1, in which a spectral envelope is computed, wherein the masking threshold, for a sub-band, is defined by a convolution between:

an expression of the spectral envelope, and a spread function involving a central frequency of said sub-band.

12. A method according to claim 1, in which information is obtained according to which the signal to be coded is tonal or not tonal, wherein the perceptual weighting of the second sub-band, with determination of the masking threshold and the normalization, are only carried on if the signal is not tonal.

13. A method of decoding an audio signal in several sub-bands, in which at least one first and one second sub-bands which are adjacent are transform decoded, wherein, in order to apply a perceptual weighting, in the transformed domain, at least to the second sub-band, the method comprises:

a determination of at least one frequency masking threshold to apply on the second sub-band, on the basis of a decoded spectral envelope, the same threshold not being applied on the first sub-band, and a normalization of said masking threshold in order to ensure a spectral continuity between said first and second sub-bands, to produce a decoded audio signal.

14. A method according to claim 13, in which a number of bits to be allocated to each sub-band is determined on the basis of a decoding of spectral envelope, wherein the bit allocation for the second sub-band at least is determined moreover according to a normalized masking curve computation, applied at least to the second sub-band.

15. A method according to claim 13, wherein the transformed signal, in the second sub-band, is weighted by a factor proportional to the square root of the normalized masking threshold for the second sub-band.

16. A non-transitory storage medium, comprising a memory of a coder of a telecommunications terminal and/or a storage medium intended to cooperate with a reader of said coder, storing a software program comprising instructions for the implementation of the coding method according to claim 1 when said instructions are executed by a processor of the coder.

17. A coder for coding a signal in several sub-bands, at least one first and one second sub-bands which are adjacent being transform coded, wherein, in order to apply a perceptual weighting, in the transformed domain, at least to the second sub-band, the coder comprises means for:

determining at least one frequency masking threshold to be applied on the second sub-band, the same threshold not being applied on the first sub-band, and normalizing said masking threshold in order to ensure a spectral continuity between said first and second sub-bands.

18. A non-transitory storage medium, comprising a memory of a decoder of a telecommunications terminal and/or a storage medium intended to cooperate with a reader of said decoder, storing a software program comprising instructions for the implementation of the decoding method according to claim 13 when said instructions are executed by a processor of the decoder.

19. A decoder for decoding a signal in several sub-bands, at least one first and one second sub-bands which are adjacent being transform decoded, wherein, in order to apply a perceptual weighting, in the transformed domain, at least to the second sub-band, the decoder comprises means for:

determining at least one frequency masking threshold to apply on the second sub-band, on the basis of a decoded spectral envelope, the same threshold not being applied on the first sub-band, and normalizing said masking threshold in order to ensure a spectral continuity between said first and second sub-bands.

* * * * *